US007487659B2

(12) United States Patent
Paletto

(10) Patent No.: US 7,487,659 B2
(45) Date of Patent: Feb. 10, 2009

(54) MACHINE FOR WORKING SHEET METAL PARTS, IN PARTICULAR A FLANGING MACHINE, AND A SYSTEM FOR DRIVING THE MACHINE

(75) Inventor: Carlo Paletto, Giaveno (IT)

(73) Assignee: O.L.C.I. Engineering S.r.l., Turin (IT)

( * ) Notice: Subject to any disclaimer, the term of this patent is extended or adjusted under 35 U.S.C. 154(b) by 0 days.

(21) Appl. No.: 10/579,252

(22) PCT Filed: Nov. 12, 2004

(86) PCT No.: PCT/EP2004/052954

§ 371 (c)(1),
(2), (4) Date: Jan. 24, 2007

(87) PCT Pub. No.: WO2005/046905

PCT Pub. Date: May 26, 2005

(65) Prior Publication Data

US 2007/0271983 A1 Nov. 29, 2007

(30) Foreign Application Priority Data

Nov. 14, 2003 (IT) ..... TO2003A0906

(51) Int. Cl.
*B21J 9/18* (2006.01)

(52) U.S. Cl. ..... 72/452.4; 72/306; 72/323; 72/447; 72/452.6

(58) Field of Classification Search ..... 72/306, 72/312–316, 386, 452.4, 452.5, 446, 407, 72/408, 442, 447, 323; 29/243.57, 243.58
See application file for complete search history.

(56) References Cited

U.S. PATENT DOCUMENTS 5,050,422 A * 9/1991 Dorsett ..... 72/450

(Continued)

FOREIGN PATENT DOCUMENTS

DE 295 11 071 U1 9/1995

(Continued)

*Primary Examiner*—Dana Ross
*Assistant Examiner*—Debra M Wolfe
(74) *Attorney, Agent, or Firm*—Sughrue Mion, PLLC

(57) ABSTRACT

The machine (20) comprises: a supporting structure (24, 26); a movable unit (28) mounted on the supporting structure (24, 26) so that it can translate along a first working direction (Z) and along a second direction (X) towards and away from a stationary workpiece-carrying structure (88); a tool-carrying unit (10, 11, 12) carried by the movable unit (28); and a driving system for controlling the movement of the movable unit (28) in the working direction (Z). The driving system includes a first motor unit (60) for controlling the rotation of a driving shaft (62) and a mechanism for converting the rotational movement of the shaft (62) into the translational movement of the movable unit (28). The motion conversion mechanism comprises a cam member (76), which is rotatably mounted on the movable unit (28) and the rotation of which is controlled by the driving shaft (62), and a roller member (78) which is rotatably mounted on the supporting structure (24, 26) and on which the cam member (76) rests. The cam member (76) has an outline (76*a*) arranged to co-operate with the roller member (78), which is suitably shaped so as to cause the movable unit (28) to move along the working direction (Z) with a predetermined movement law upon rotation of the cam member (76).

15 Claims, 23 Drawing Sheets

U.S. PATENT DOCUMENTS 5,647,243 A * 7/1997 Zampini ..... 72/452.6

FOREIGN PATENT DOCUMENTS

EP 0 642 854 A 3/1995

EP 0 924 005 A2 6/1999

EP 0 933 148 A 8/1999

* cited by examiner

MACHINE FOR WORKING SHEET METAL PARTS, IN PARTICULAR A FLANGING MACHINE, AND A SYSTEM FOR DRIVING THE MACHINE

This is a National Stage entry of International Application PCT/EP2004/052954, with an international filing date of Nov. 12, 2004, which was published as WO 2005/046905 A1, and the complete disclosure of which is incorporated into this application by reference.

BACKGROUND OF THE INVENTION

The present invention relates to a machine for working sheet metal parts and to a driving system for such a machine. More particularly, the invention refers to a flanging machine for connecting by flanging sheet metal panels, such as, for example, car body panels.

FIGS. 1A to 1C of the appended drawings schematically show the operation of flanging a pair of sheet metal panels 1 and 2, that is, an outer panel and an inner panel, respectively. The two panels 1, 2 are first arranged (FIG. 1A) with respective flat edge portions 3 and 4 in contact with each other on a workpiece-carrying structure (not shown), generally formed by a bed suitably shaped in accordance with the piece to be worked. The flat edge portion 3 of the outer panel 1 has an edge 3*a* which is initially bent at a given angle (typically 90 degrees) with respect to the plane of the portions 3 and 4 (FIG. 1A) and is intended to be further bent and pressed on the flat edge portion 4, thereby clamping the latter against the underlying portion 3. The flanging operation usually includes a first phase, known as "pre-flanging", in which the edge 3*a* is bent to a given angle (typically 45 degrees) with respect to the plane of the edge portions 3 and 4 by applying a first force F1 preferably perpendicular to the said plane (FIG. 1B), and a subsequent phase, or "final flanging", in which the edge 3*a* is further bent until it contacts the flat edge portion 4 and is then pressed against the latter by applying a second force F2, also preferably perpendicular to the plane of the portions 3 and 4 (FIG. 1C).

For the sake of simplicity, it will be assumed hereinafter that the two flat edge portions 3 and 4 of the panels to be flanged are arranged in a horizontal plane and therefore that the direction along which the flanging forces are applied is vertical. The terms "horizontal" and "vertical" are thus to be understood, in the description and the claims which follow, as parallel to the plane on which the edge portions of the panels to be flanged lie and as perpendicular to that plane.

The flanging operation described above is commonly performed with the use of a tool-carrying unit 10 of the same type as that schematically shown in FIG. 2. The tool-carrying unit 10 is mounted on the flanging machine (not shown) so that it can be moved vertically to perform the pre-flanging and the final-flanging operations, as well as moved substantially horizontally towards or away from the working area in order, for example, to allow the workpiece to be loaded or unloaded.

The unit 10 carries a first, pre-flanging tool 11 having a working surface 11*a* inclined at the pre-flanging angle (typically 45 degrees) with respect to the vertical direction, and a second, final-flanging tool 12 having a working surface 12*a* inclined at 90 degrees with respect to the vertical direction.

A flanging machine of the above-mentioned type is known, for example, from European patent application EP 0 924 005. According to this known solution, the vertical movement of the tool-carrying unit is driven by a screw mechanism controlled by an electric motor, whereas the movement towards and away from the working area (in this case, a tilting movement) is driven by a leverage controlled by a pneumatic cylinder.

The use of a screw mechanism for driving the vertical movement (working movement) of the flanging machine has first of all the disadvantage of a high cost, due both to the high precision required for the production of the screw and to the complexity of the electronic control system required to ensure the correct operation of the machine. Moreover, the precision of the machine, and hence the quality of the worked pieces, may tend to decrease with time as a result of the plays due to the wear of the screw mechanism.

German utility model DE 295 11 071 U discloses a driving sys-tem for driving a tool-carrying unit of a machine for the working of sheet metal parts, in particular a bending or punching machine, wherein the tool-carrying unit is slidably mounted along a vertical direction on a supporting structure of the machine. This known driving system comprises a driving shaft rotatably mounted on the supporting structure and carrying two cam discs engaging with two rollers mounted on the tool-carrying unit. The one cam disc and roller assembly controls the working stroke of the tool-carrying unit, while the other cam disc and roller assembly controls the return stroke of the tool-carrying unit.

A flanging machine for the working of sheet metal parts is known from European patent application EP-A-0 933 148. In this case, the vertical reciprocating motion of the tool-carrying unit is driven by an electric motor which is fixedly mounted on a supporting structure of the machine and operates a driving shaft rotatably mounted on the sup-porting structure and connected to the tool-carrying unit by means of a cam and lever mechanism.

SUMMARY OF THE INVENTION

It is therefore the object of the present invention to overcome the shortcomings of the prior art discussed above, by providing a machine for working sheet metal parts, in particular for performing flanging operations, which has a simple structure, a low cost and a precise and reliable operation with time.

The advantages of a machine according to the invention with respect to the prior art can be summarized in the following points:

- simpler construction,
- more compact sizes,
- lower manufacturing and working costs,
- lower number of components,
- higher reliability,
- less frequent and easier servicing operations, and
- greater working force which can be exerted, and therefore greater length which can be worked.

BRIEF DESCRIPTION OF THE DRAWINGS

Further characteristics and advantages of the invention will become apparent from the detailed description which follows, given purely by way of non-limiting example with reference to the appended drawings, in which:

FIGS. 12A to 12K are partial side views which illustrate schematically the work-cycle of a flanging machine according to the invention.

DETAILED DESCRIPTION OF THE INVENTION

Figure 2:
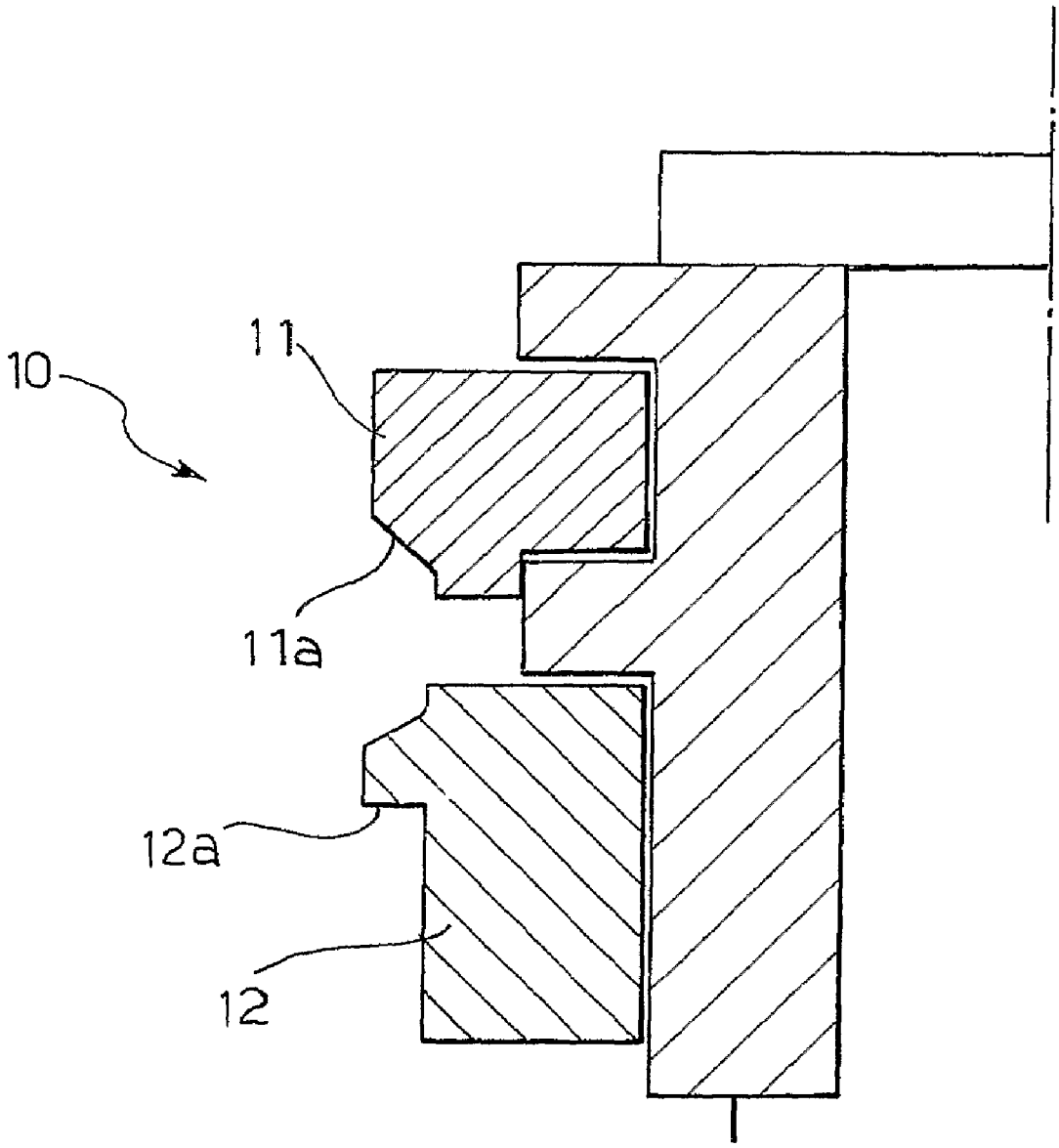
FIG. 2 is a side sectional view which shows a tool-carrying unit adapted to carry out the flanging operation illustrated in FIGS. 1B and 1C.
Figure 3:
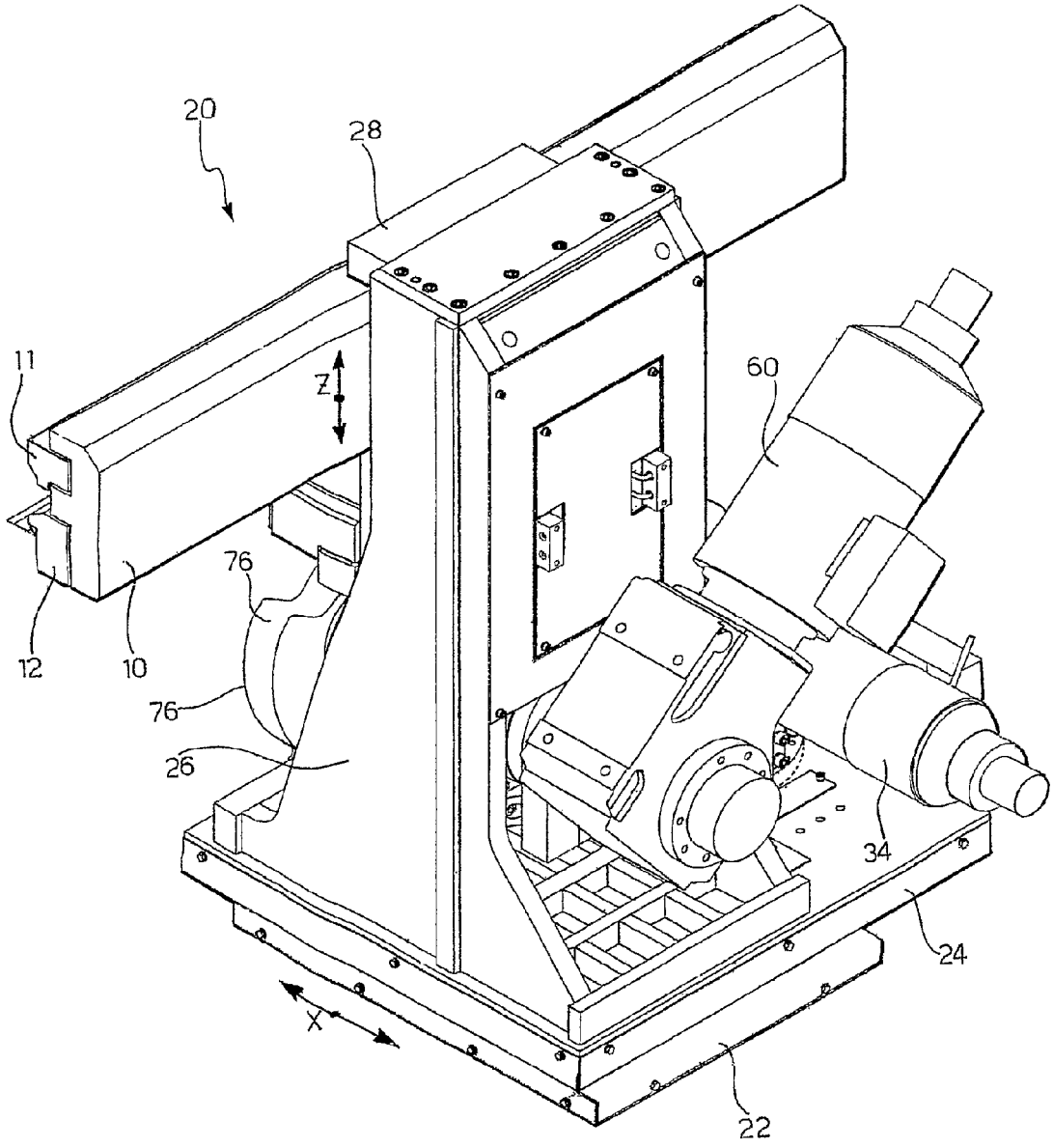
FIG. 3 is a perspective view from above and from the rear side which shows a flanging machine according to the invention.

Referring first to FIGS. 3 to 10, a flanging machine according to the invention, generally indicated 20, comprises:

a stationary base 22, intended to be fixed to the floor or mounted on a proper support plane (not illustrated) arranged parallel to the plane in which the edge portions of the sheet metal panels to be connected by flanging lie;

a movable base 24, mounted on the stationary base 22 so as to be movable parallel to the latter towards or away from the working area (double arrow X), hereinafter indicated as longitudinal direction;

a main body 26 fixed to the movable base 24 and having substantially a portal-like structure;

a movable unit 28, mounted on the main body 26 so as to be movable vertically (double arrow Z), that is, perpendicularly to the plane of the two bases 22, 24; and a tool-carrying unit 10 of the same type as that described above with reference to FIG. 2, which is fixed onto the movable unit 28.

In order to guide the translational movement of the movable base 24 along the direction X, the base is provided with a pair of longitudinal rails 30 (one of which can be partially seen in the sectional view of FIG. 6) arranged to slide on respective guide surfaces 32*a* provided by two pairs of sliding blocks 32 mounted on the stationary base 22 (FIG. 7), The translational movement of the movable base 24 is driven by an electric geared motor unit 34 through a crank mechanism 36 (FIG. 8) which converts the rotational movement into rectilinear movement.

Figure 7:
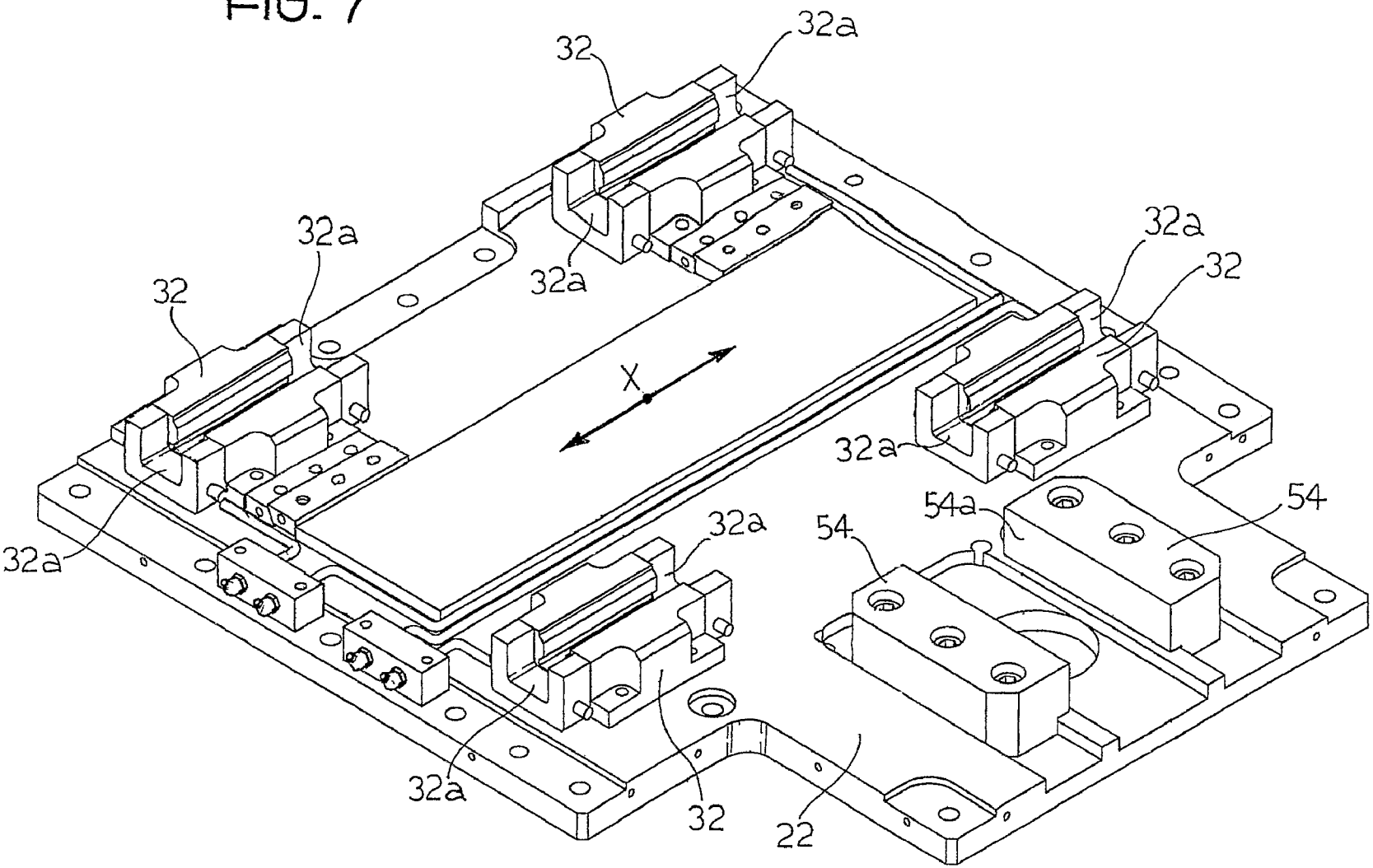
FIG. 7 is a perspective view from above which shows a stationary base of the flanging machine of FIG. 3.
Figure 8:
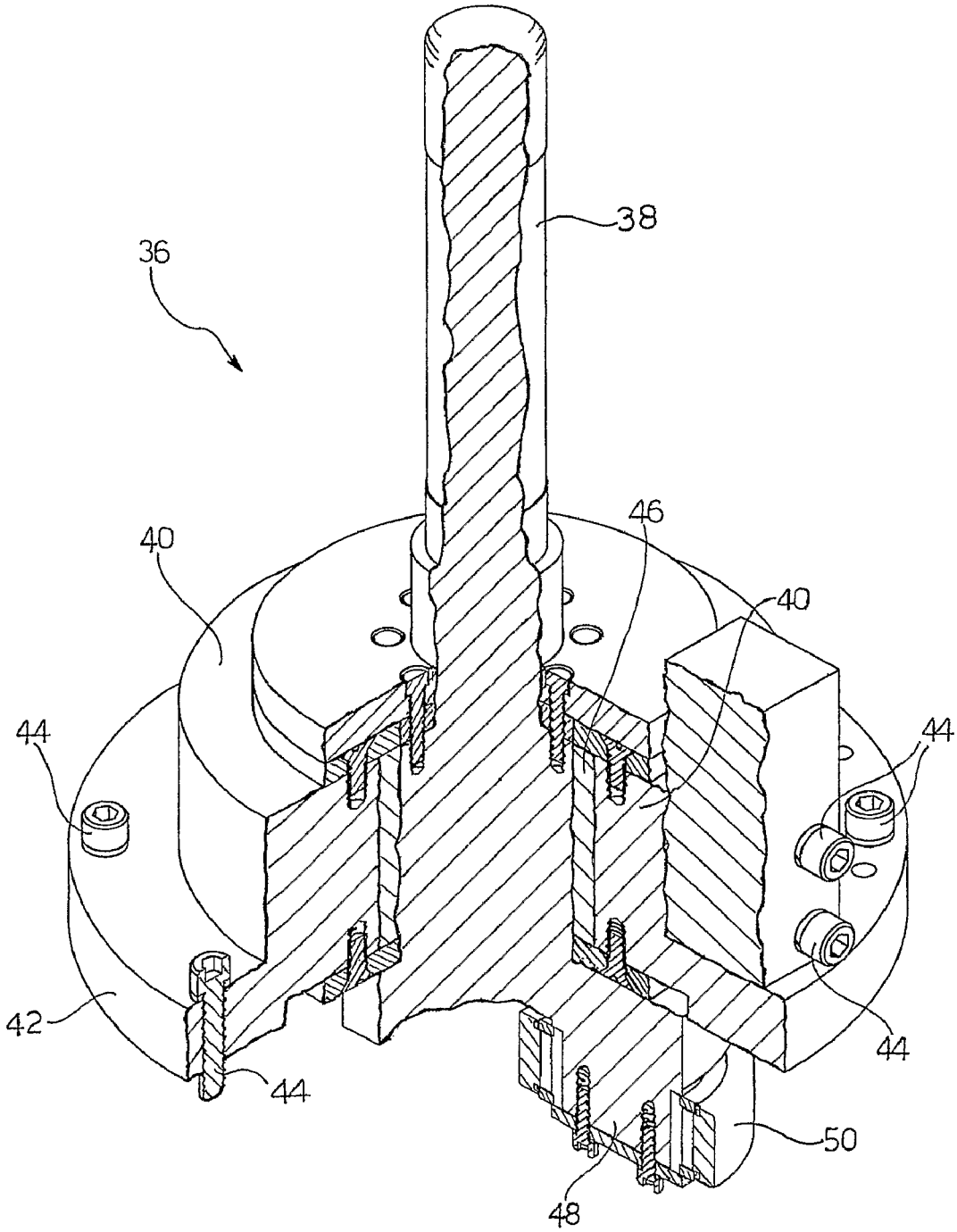
FIG. 8 is a perspective view which shows a section of a crank mechanism of the flanging machine of FIG. 3 designed to control the longitudinal horizontal movement of the machine towards and away from the workpiece.
Figure 9:
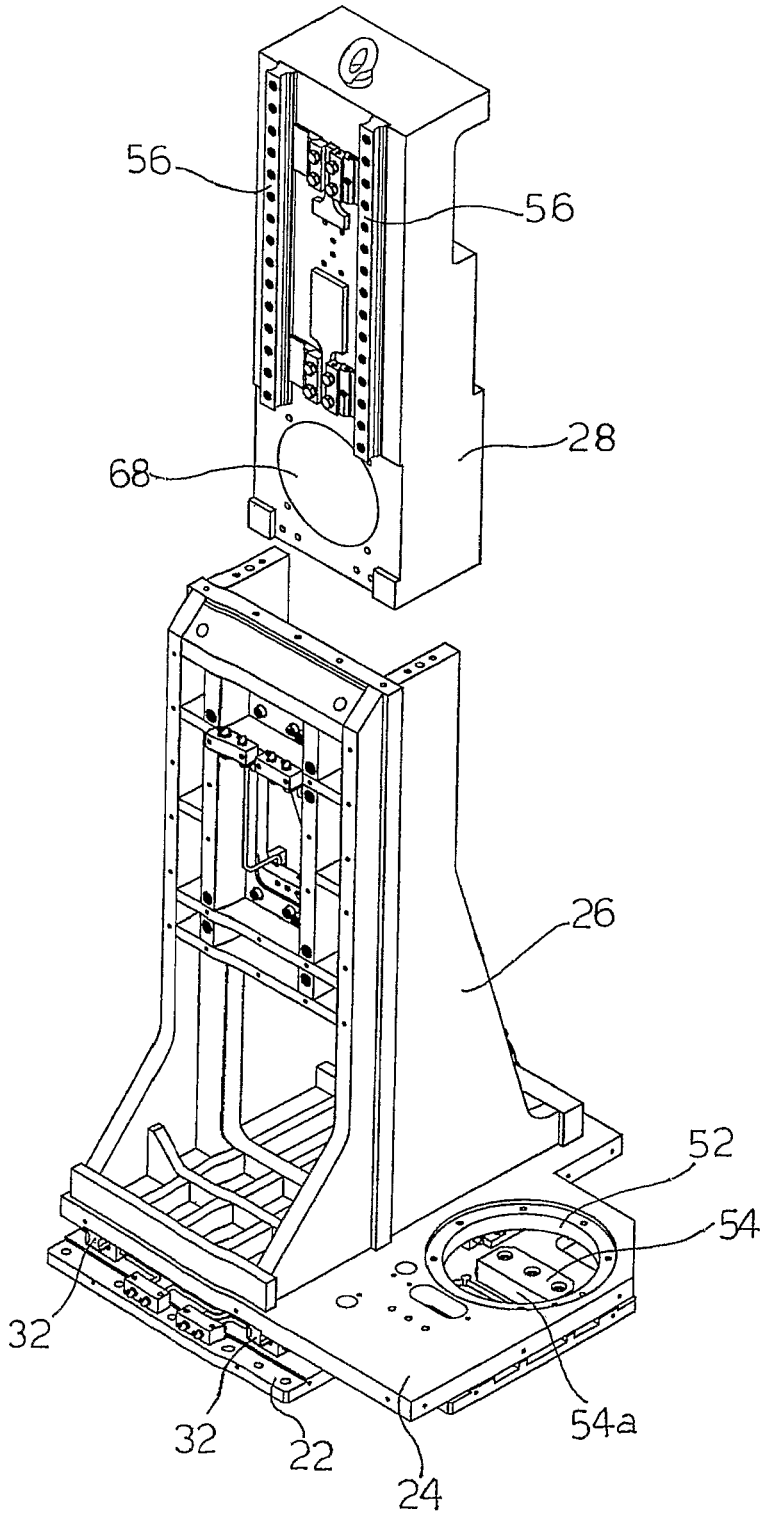
FIG. 9 is a perspective view from above which shows a main body and a movable unit of the flanging machine of FIG. 3, in the assembled condition.
Figure 10:
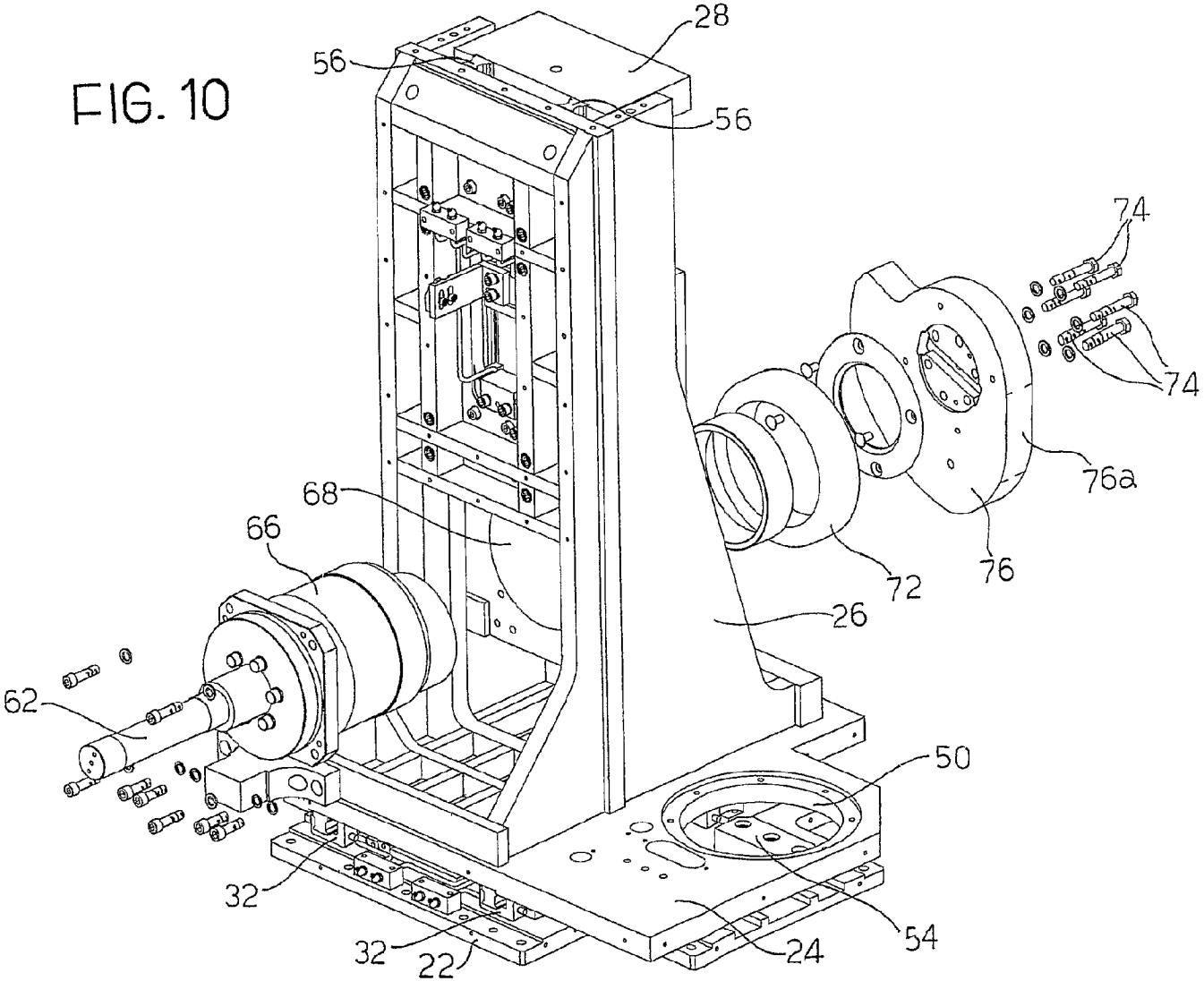
FIG. 10 is an exploded perspective view which shows the main body and a shaft and cam assembly for controlling the vertical movement of the movable unit of the flanging machine of FIG. 3.

With reference to FIGS. 7 and 8, the crank mechanism 36 comprises a vertical input shaft 38 connected at its top to the geared motor unit 34 so as to rotated by the latter. The shaft 38 is rotatably mounted by means of a bush 46 on a support body 40, which is fixed by screws 44 to the movable base 24 in a flange-like portion 42 thereof. The shaft 38 forms at its bottom a cylindrical extension 48 acting as a crank, which is placed eccentrically with respect to the axis of rotation of the shaft and on which a roller 50 is rotatably mounted. The roller 50, together with the associated extension 48, extends downwards into a through opening 52 provided in the movable base 24 (FIG. 9) and is guided between a pair of vertical surfaces 54*a* which are oriented perpendicularly to the longitudinal direction X and are provided by respective guide members 54 secured to the stationary base 22.

In this way, when the geared motor unit 34 drives the rotation of the shaft 38, the roller 50 rolls along the guide surfaces 54*a* of the stationary base, while as a reaction the movable base 24, which is fast for translation with the shaft 38, moves longitudinally with respect to the stationary base 22 along the longitudinal guides 30, 32. The direction of the longitudinal movement of the movable base 24 is evidently set by suitably controlling the direction of rotation of the shaft 38.

In order to guide the translational movement of the movable unit 28 along the direction Z, the unit is provided with a pair of vertical rails 56 (FIG. 9) arranged so as to slide on respective guide surfaces provided by two pairs of sliding blocks 58 (which can be partially seen in the sectional view of FIG. 6) mounted on the main body 26, in a similar manner as that described above in connection with the movable base 24.

The vertical translational movement of the movable unit 28 is driven by an electric geared motor unit 60 configured to rotate a driving shaft 62. The geared motor unit 60 is fastened to the movable unit 28 by means of screws 64, on the opposite side with respect to the working area. The shaft 62, which extends longitudinally, is supported for rotation in a support body 66 fitted in a through hole 68 of the movable unit 28.

The shaft 62 forms an end portion 70 (FIG. 6) which has an outer eccentric-shaped surface and projects from the support body 66 towards the working area. Onto the eccentric portion 70 is secured an annular member 72 the outline of which extends parallel to that of the outer eccentric surface of the portion 70. Alternatively, there may be provided a cylindrical end portion 70 coaxial with the shaft 62 and an annular eccentric-shaped member 72.

Figure 4:
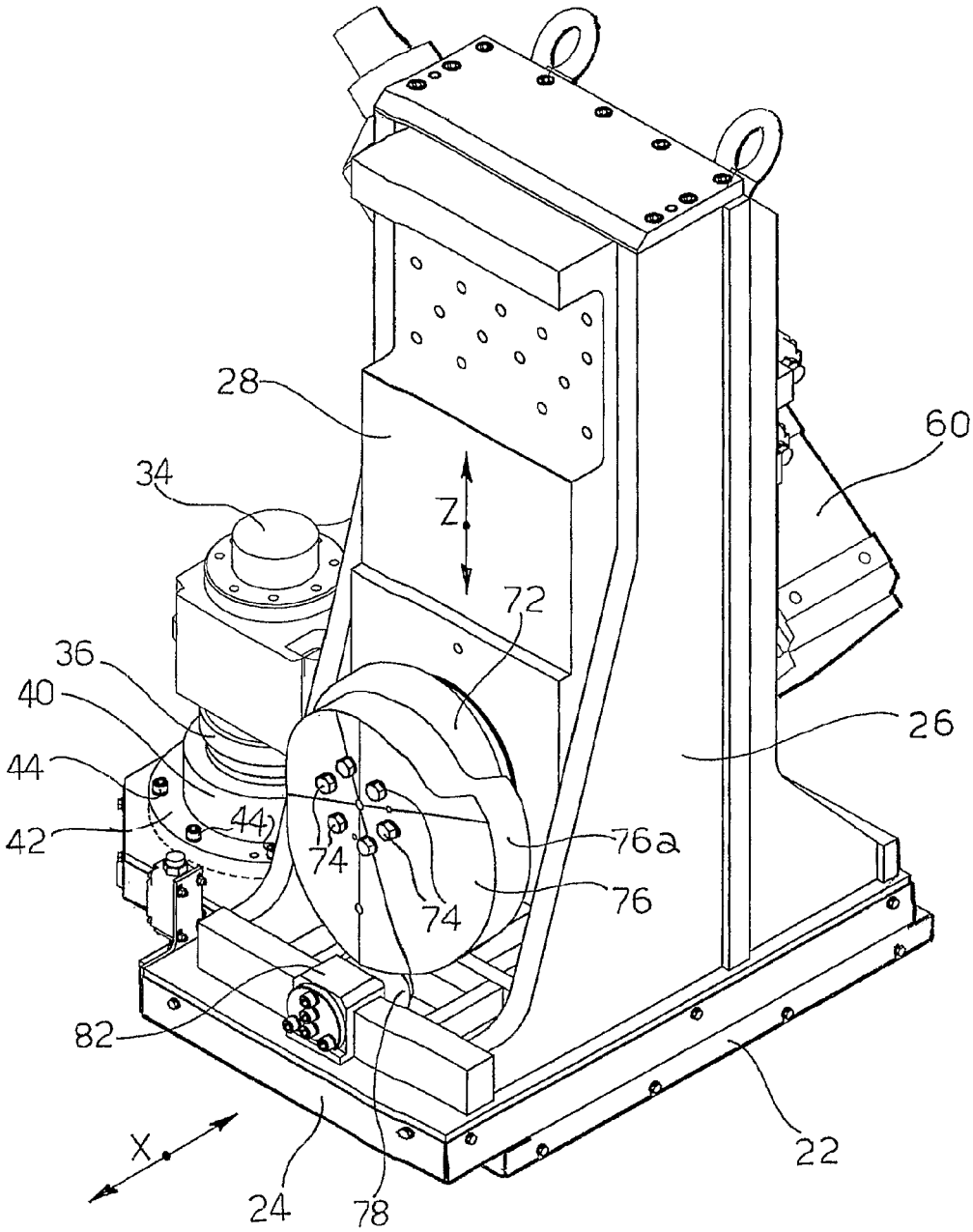
FIG. 4 is a perspective view from above and from the front side which shows the flanging machine of FIG. 3, without tool-carrying unit.
Figure 5:
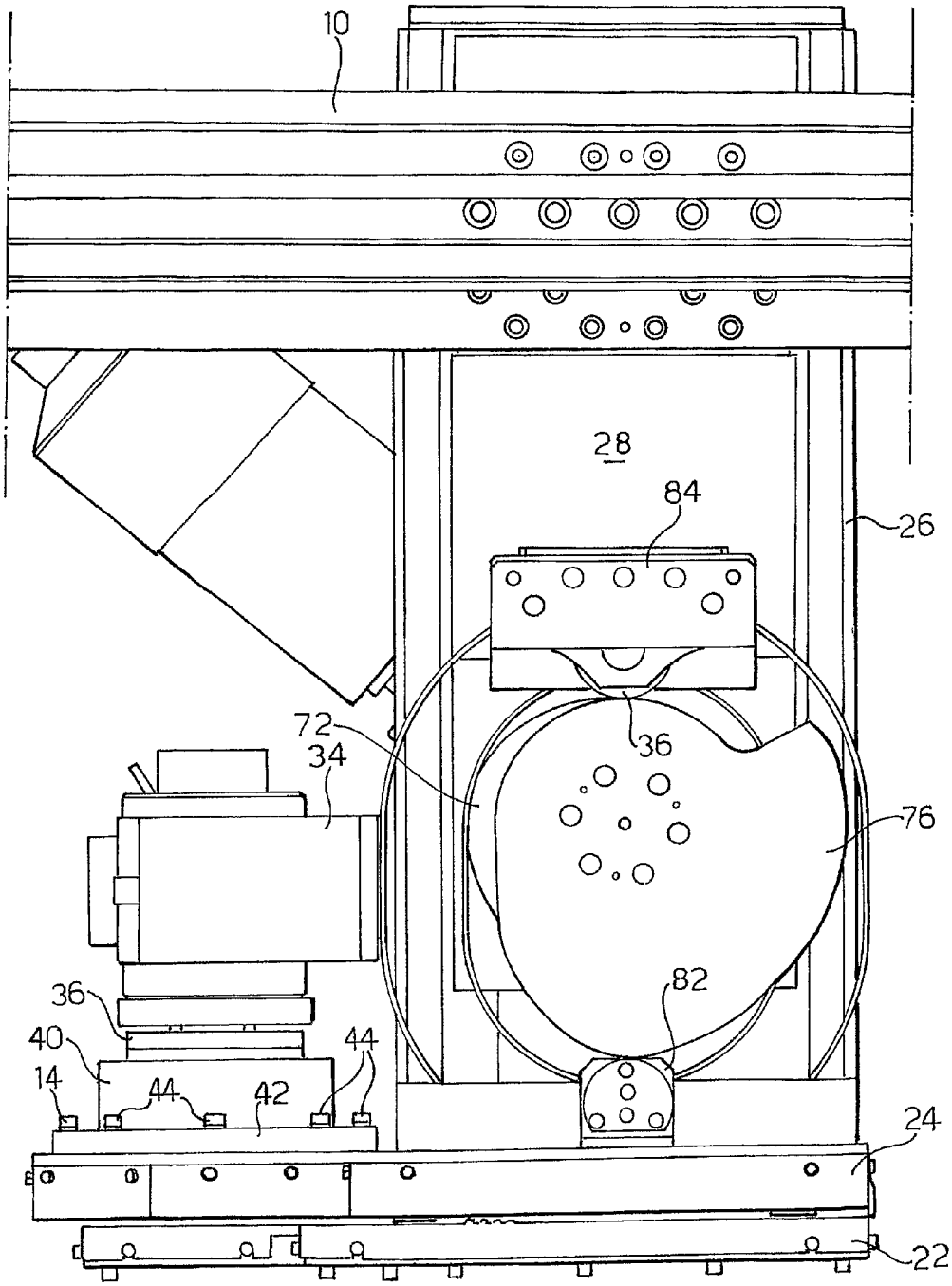
FIG. 5 is a front elevation view of the flanging machine of FIG. 3.
Figure 6:
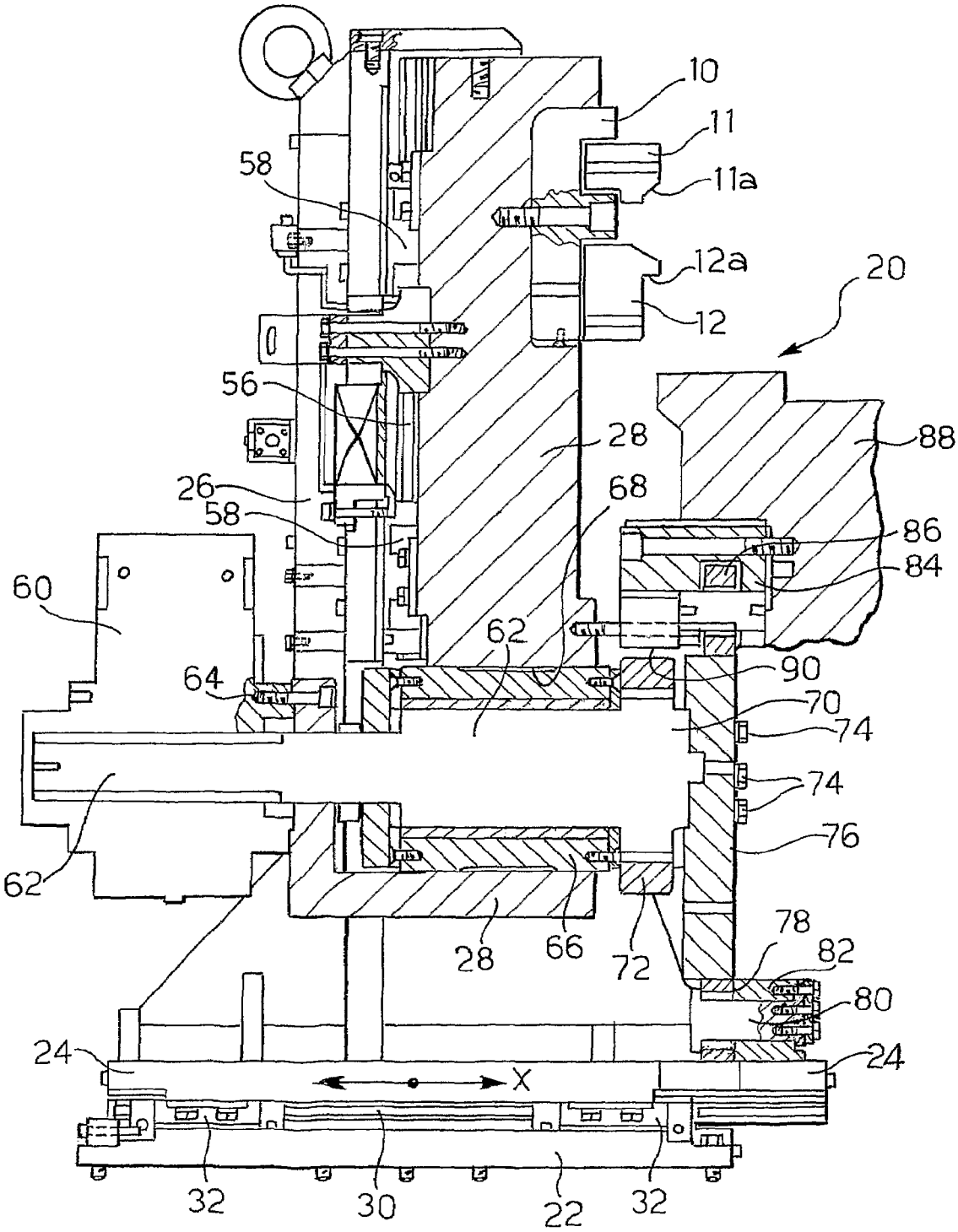
FIG. 6 is a side sectional view of the flanging machine of FIG. 3.

A cam 76 is also fastened by means of screws 74 to the end portion 70 of the shaft 62 and has an outer surface 76*a* with an outline suitably shaped so as to control the vertical movement of the movable unit 28 according to a predetermined law, as will be described in detail further on. The cam 76 rests with its outer surface 76*a* on the outer cylindrical surface of a lower roller 78 rotatably mounted about a stationary shaft 80 of longitudinal axis, which is supported by a support member 82 attached to the movable base 24 (FIGS. 4 and 6).

An upper roller 86 (FIGS. 5 and 6) is rotatably mounted in a support portion 84 attached to a workpiece-carrying structure 88 (schematically illustrated in FIGS. 12A to 12K), the outer cylindrical surface of the roller co-operating with the outer surface 76*a* of the cam 76 during the pre-flanging phase, as will be explained in detail in the following part of the description.

According to a preferred embodiment of the invention, the flanging machine 20 is configured to perform a flanging operation of the type of that described in the introductory part of the description, that is, an operation consisting of a first, pre-flanging phase and a second, final-flanging phase. With reference to FIGS. 12A to 12K the work-cycle performed by the machine 20 will be described now.

Figure 1A:
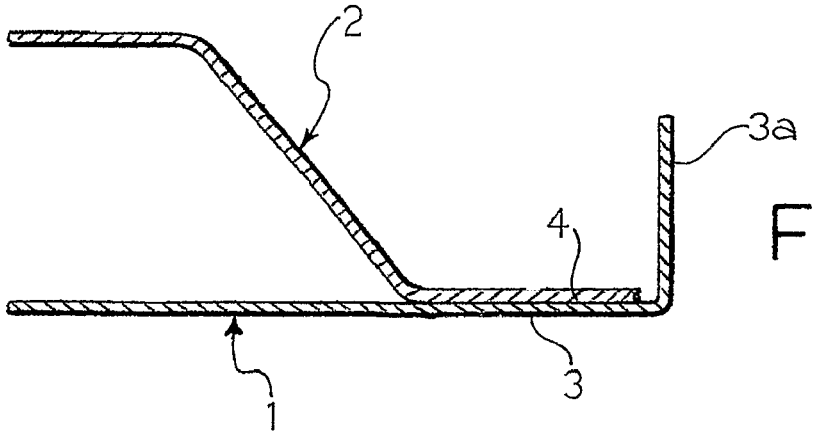
FIG. 1A is a side sectional view which shows a pair of sheet metal panels arranged to be connected to each other by a typical double-phase flanging operation.
Figure 1B:
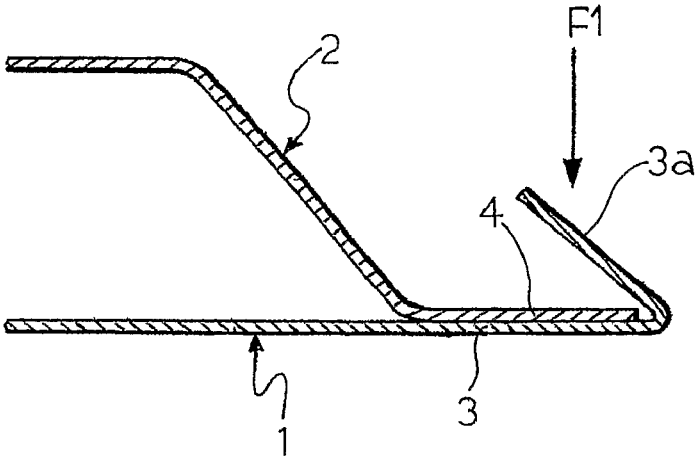
FIG. 1B is a side sectional view which shows the two panels of FIG. 1A after the 45-degrees pre-flanging phase.
Figure 1C:
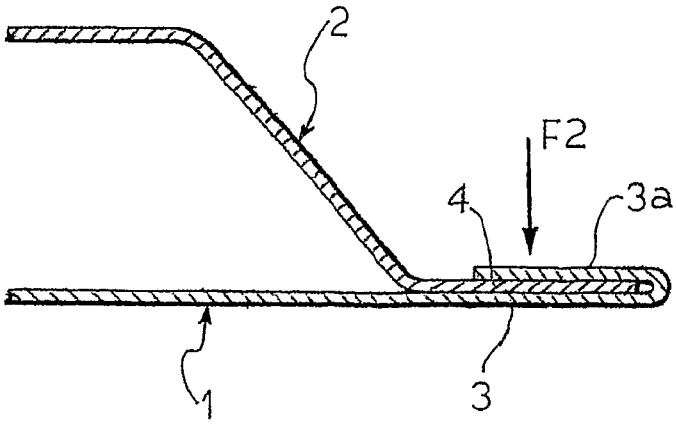
FIG. 1C is a side sectional view which shows the two panels of FIG. 1A at the end of the final-flanging phase.

The flanging machine is arranged first in a "loading/unloading" position (FIG. 12A), in which the movable unit 28 is longitudinally spaced from the workpiece-carrying structure 88 so as to allow the loading of the workpieces to be flanged (for example, the panels 1 and 2 shown in FIGS. 1A to 1C).

Next (FIG. 12B), the movable unit 28 is longitudinally moved towards the workpiece-carrying structure 88 (as indicated by arrow $B_X$) until the pre-flanging tool 11 is brought into contact with, or at least close to, the upper, 90-degree-bent edge 3*a* of the panel 1. The position so reached by the machine is indicated as "pre-flanging start" position.

At this time (FIG. 12C), the pre-flanging phase is performed by vertically moving the movable unit 28 downwards (arrow $C_Z$) until the edge 3*a* of the panel 1 is bent up to 45 degrees. The position so reached by the machine is indicated as "pre-flanging end" position.

Figure 12A:
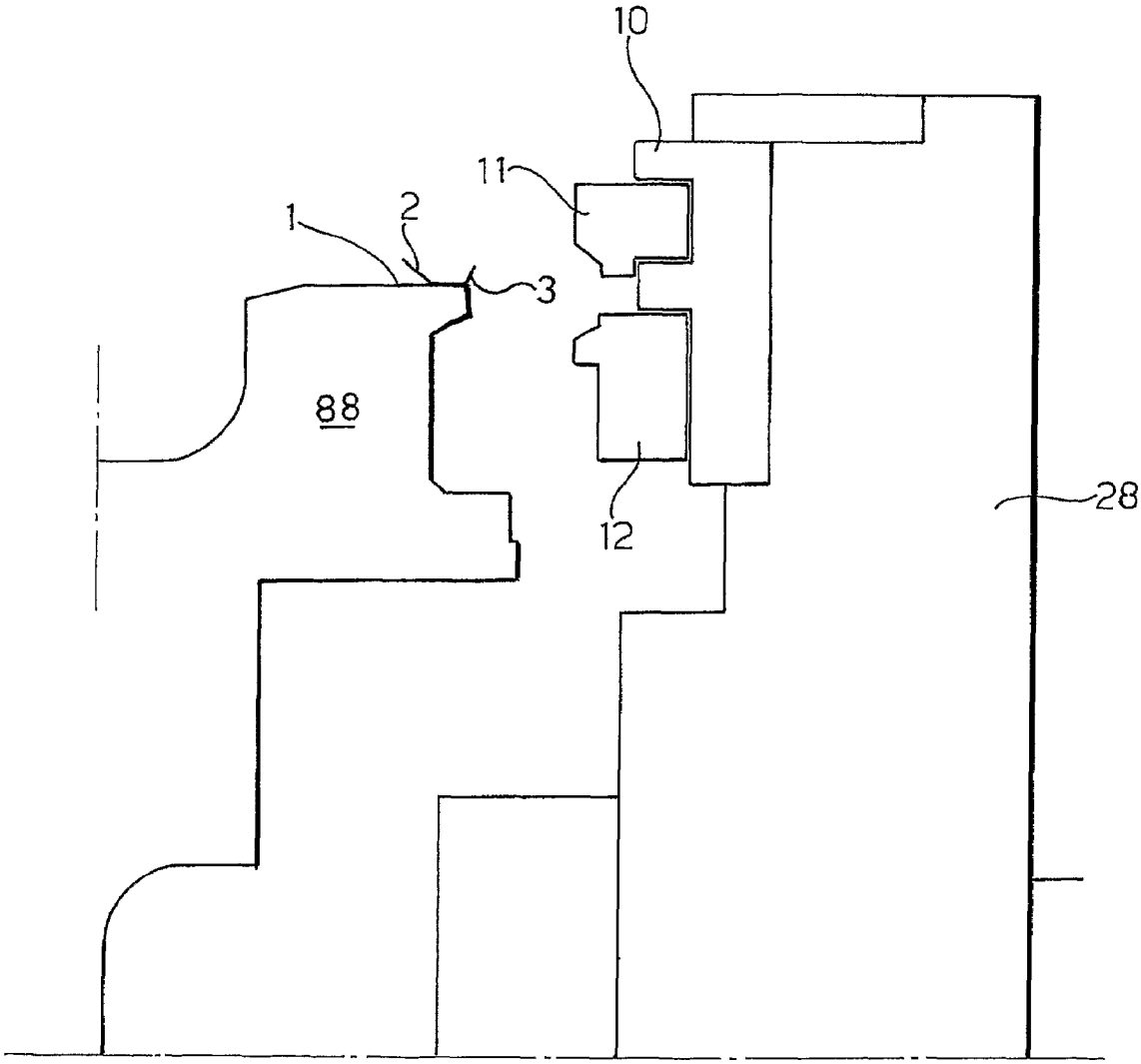
Figure 12B:
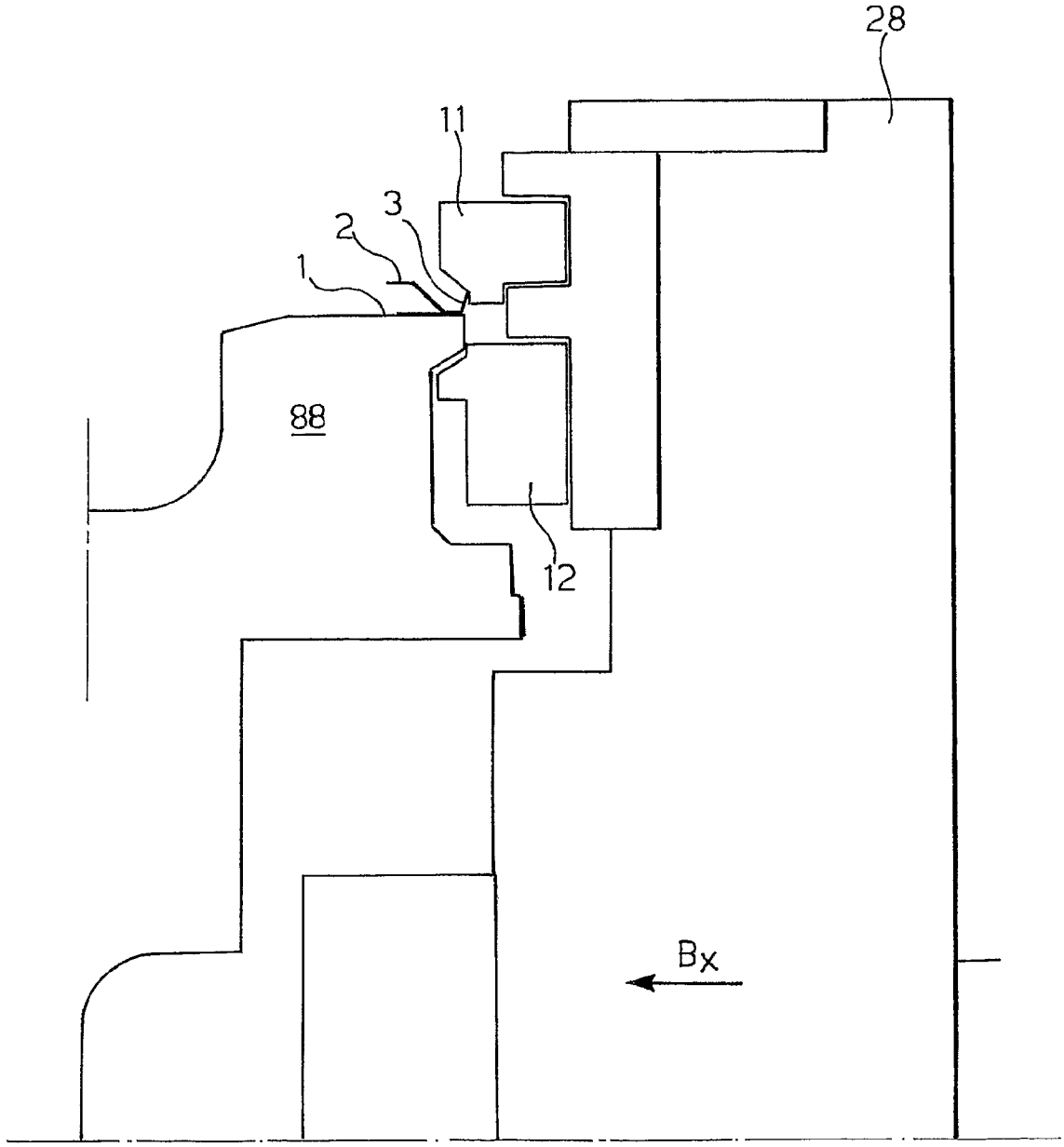
Figure 12C:
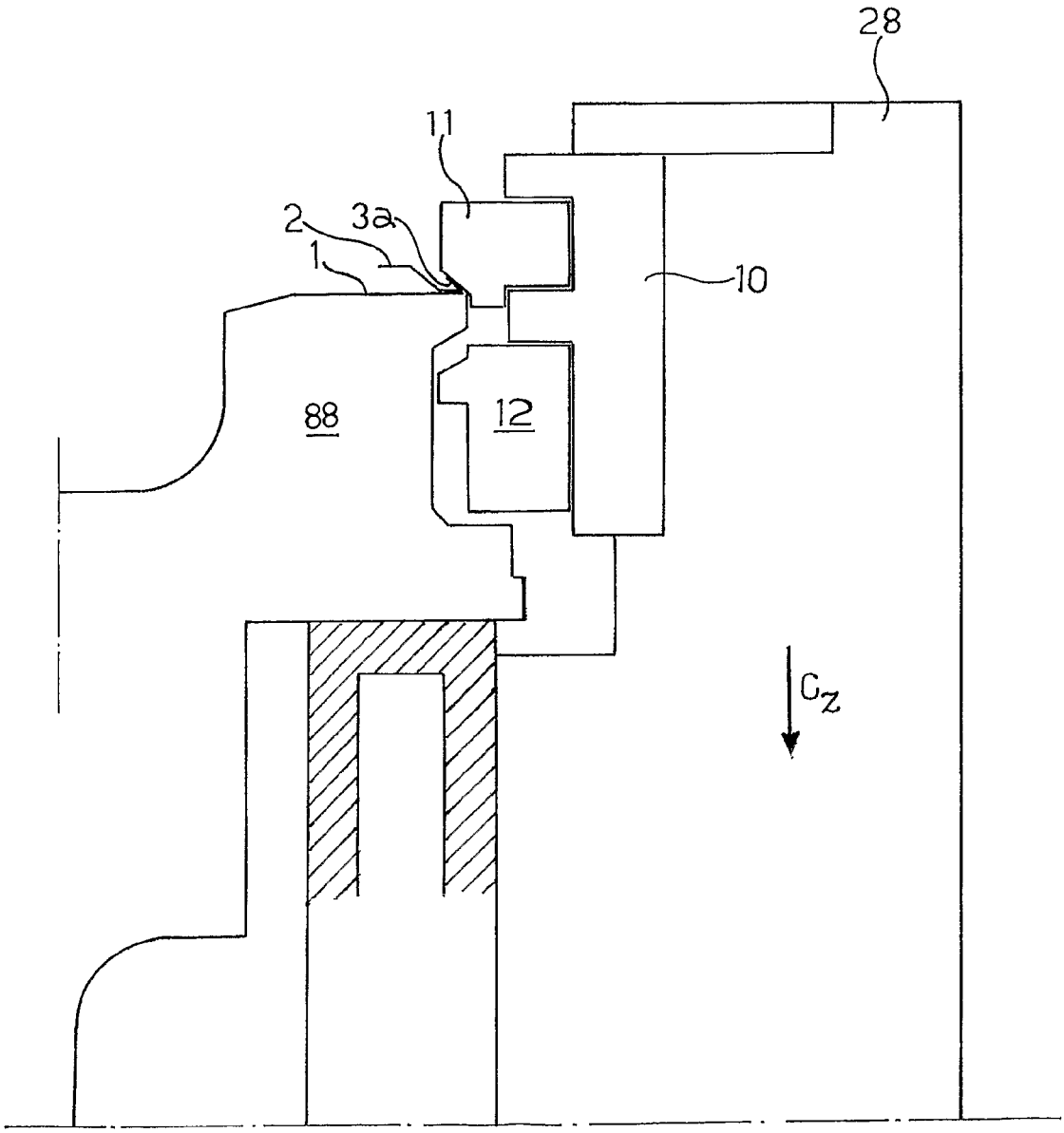
Figure 12D:
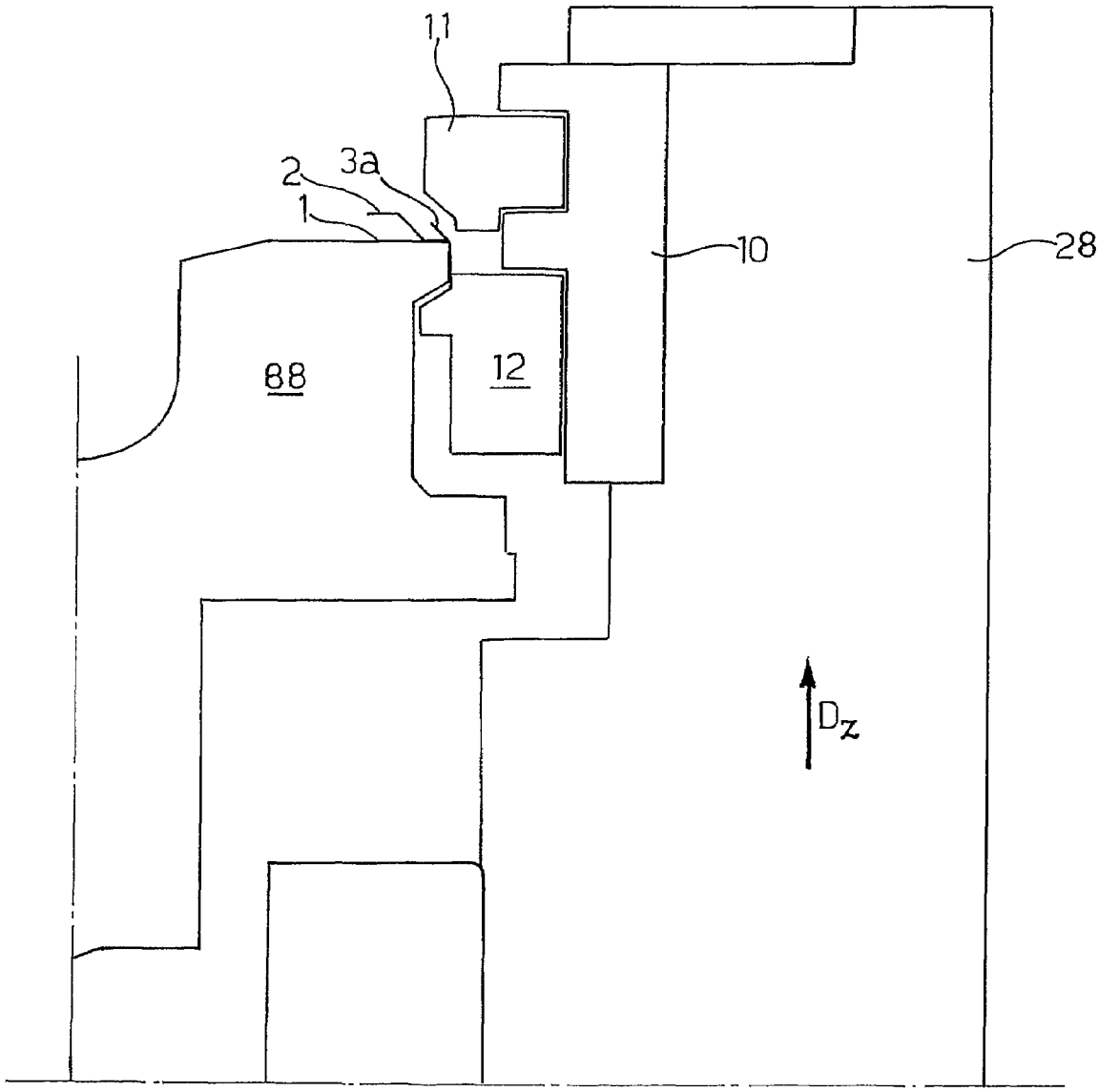

FIG. 12D shows the machine in a "detachment after pre-flanging" position, reached by vertically moving the movable unit 28 upwards (arrow $D_Z$) so as to move the pre-flanging tool 11 away from the edge 3*a* of the panel 1.

Figure 12E:
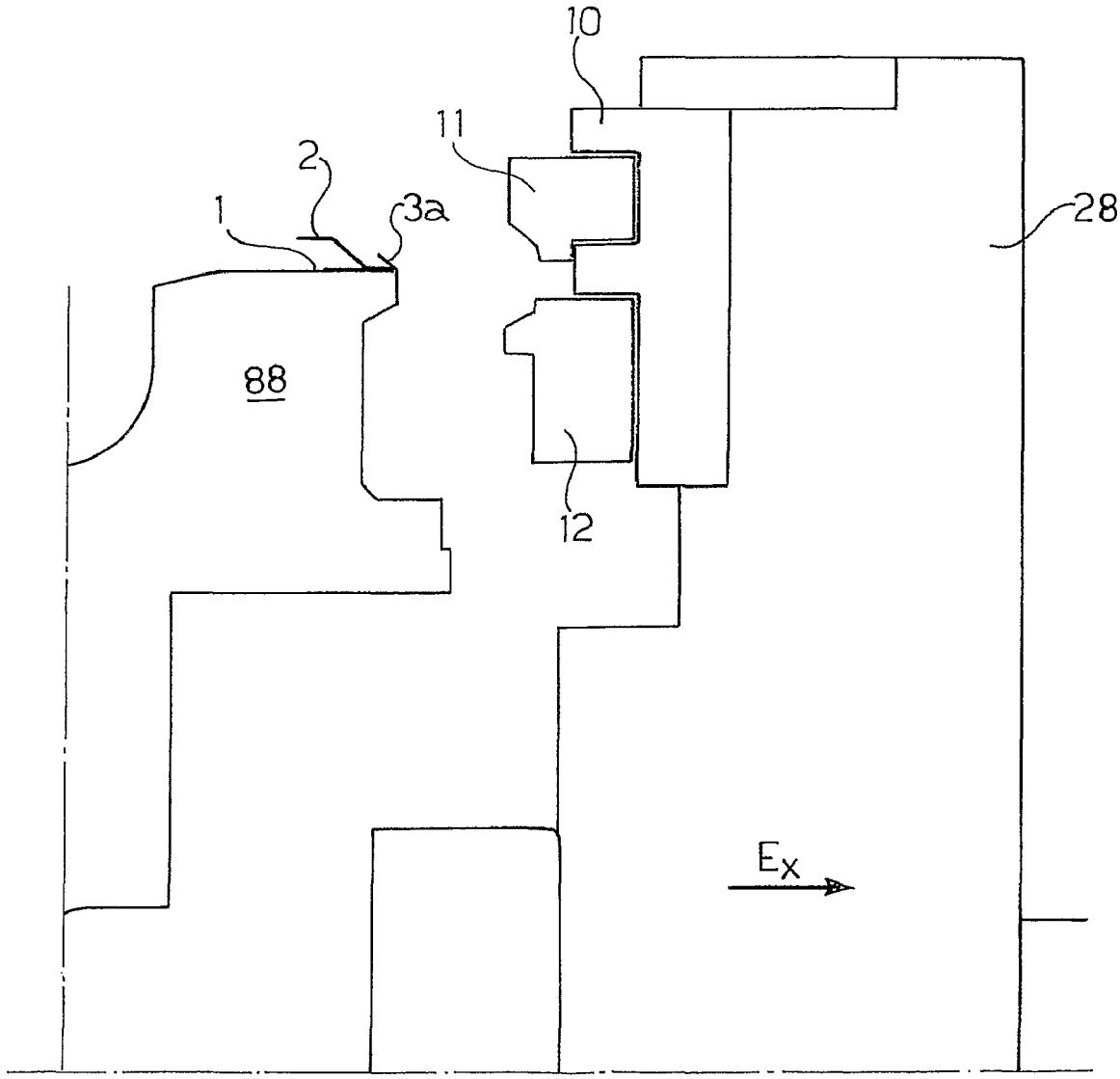

The movable unit 28 is then moved away from the workpiece-carrying structure 88 by a longitudinal movement (arrow $E_X$) and reaches again the "loading/unloading" position shown in FIG. 12E.

Figure 12F:
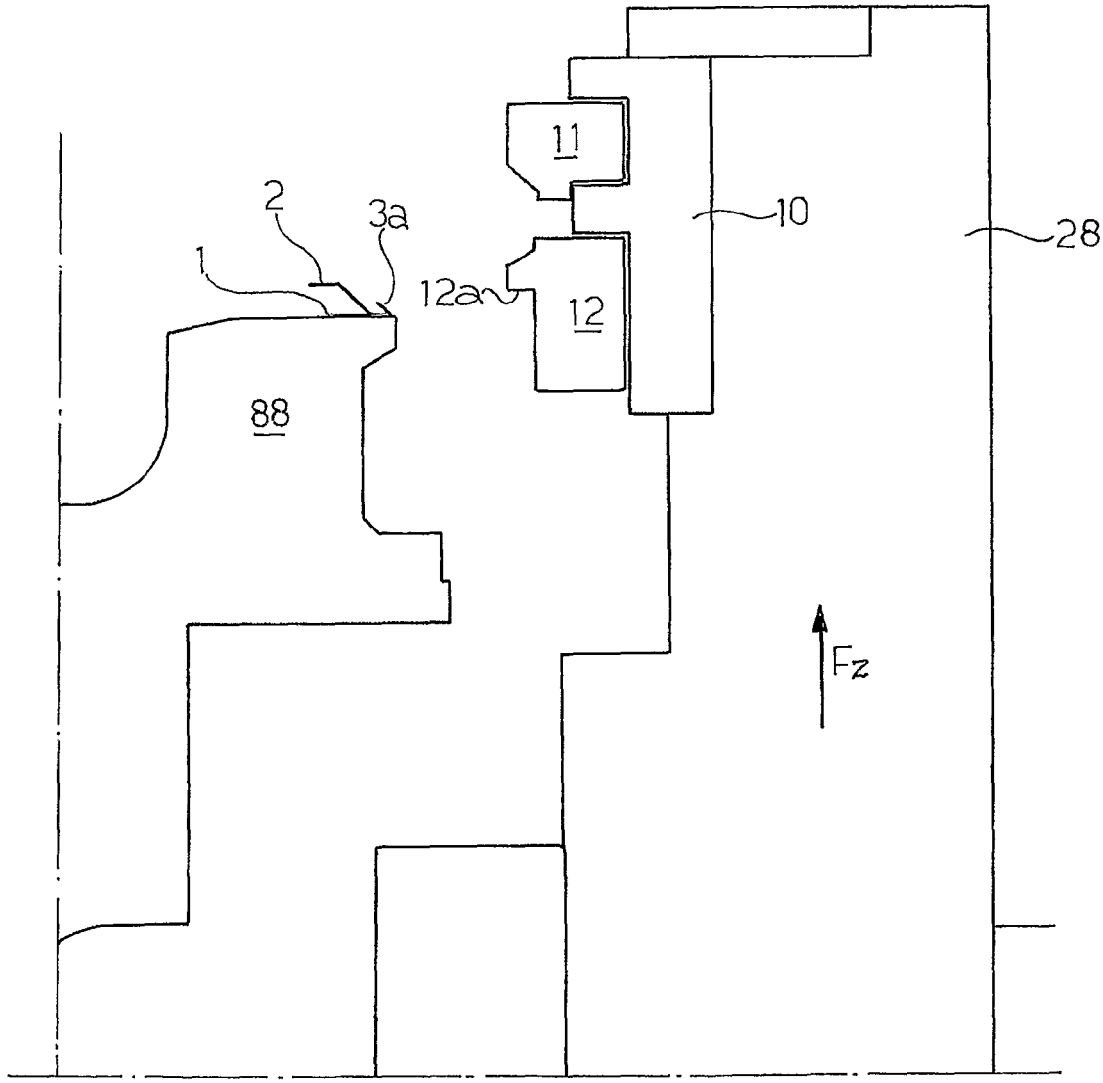

FIG. 12F shows the flanging machine in a "preparation for final flanging" position, reached by vertically moving the movable unit 28 upwards (arrow $F_Z$) until the working surface 12*a* of the final-flanging tool 12 is brought to a higher level than the upper end of the edge 3*a* of the panel 1.

Figure 12G:
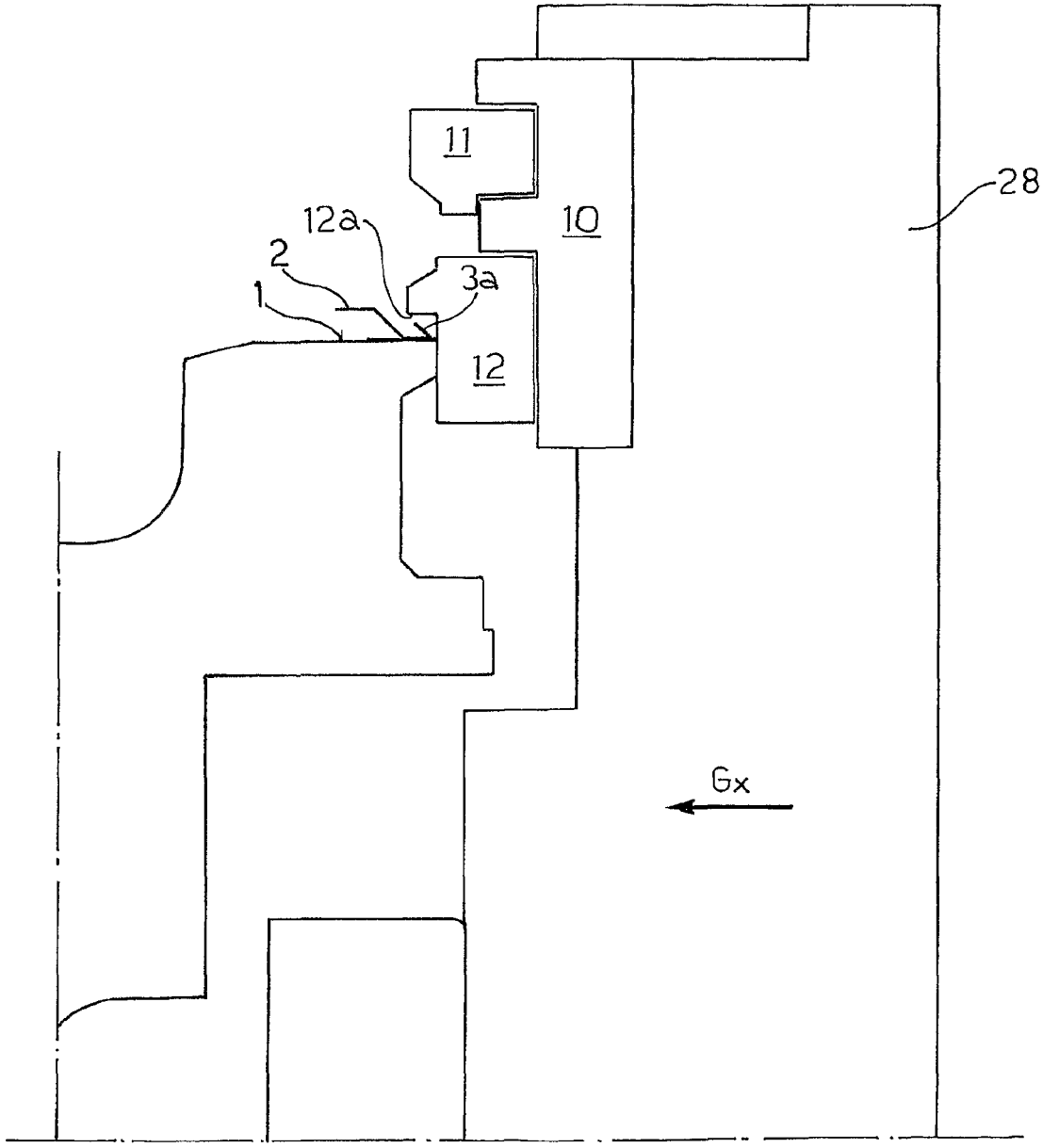

FIG. 12G shows then the machine in a "final-flanging start" position, reached by longitudinally moving the movable unit 28 towards the workpiece-carrying base (arrow $G_X$) until the working surface 12*a* of the final-flanging tool 12 is brought above the edge 3*a* of the panel 1.

At this time (FIG. 12H), the final flanging is performed wherein the movable unit 28 is vertically moved downwards (arrow $H_Z$) until the edge 3*a* of the panel 1 is further bent by 45 degrees and is finally pressed against the underlying edge 4 of the other panel 2. At the end of this phase, the machine is in a position indicated as "final-flanging end" position.

Figure 12H:
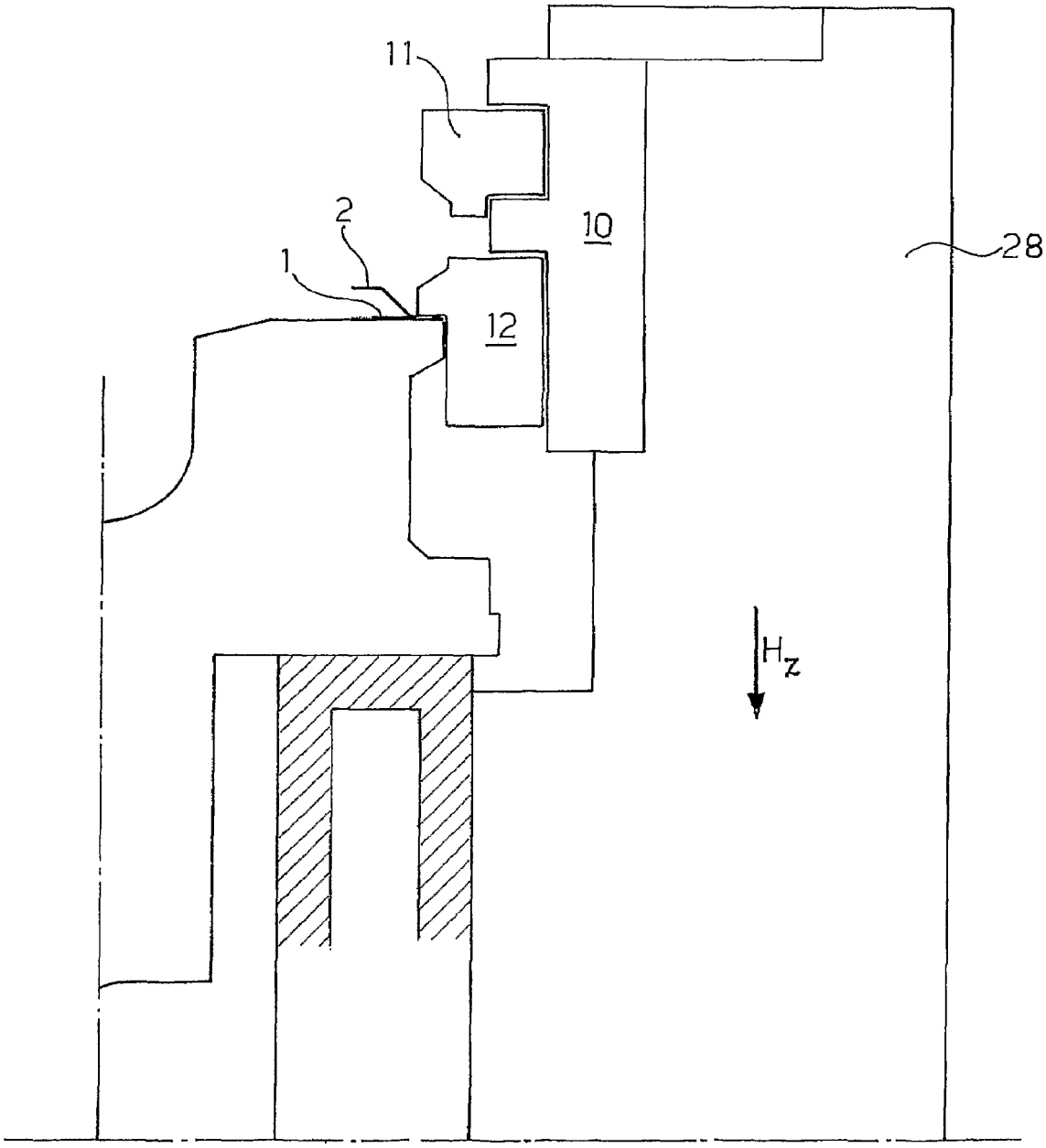
Figure 12K:
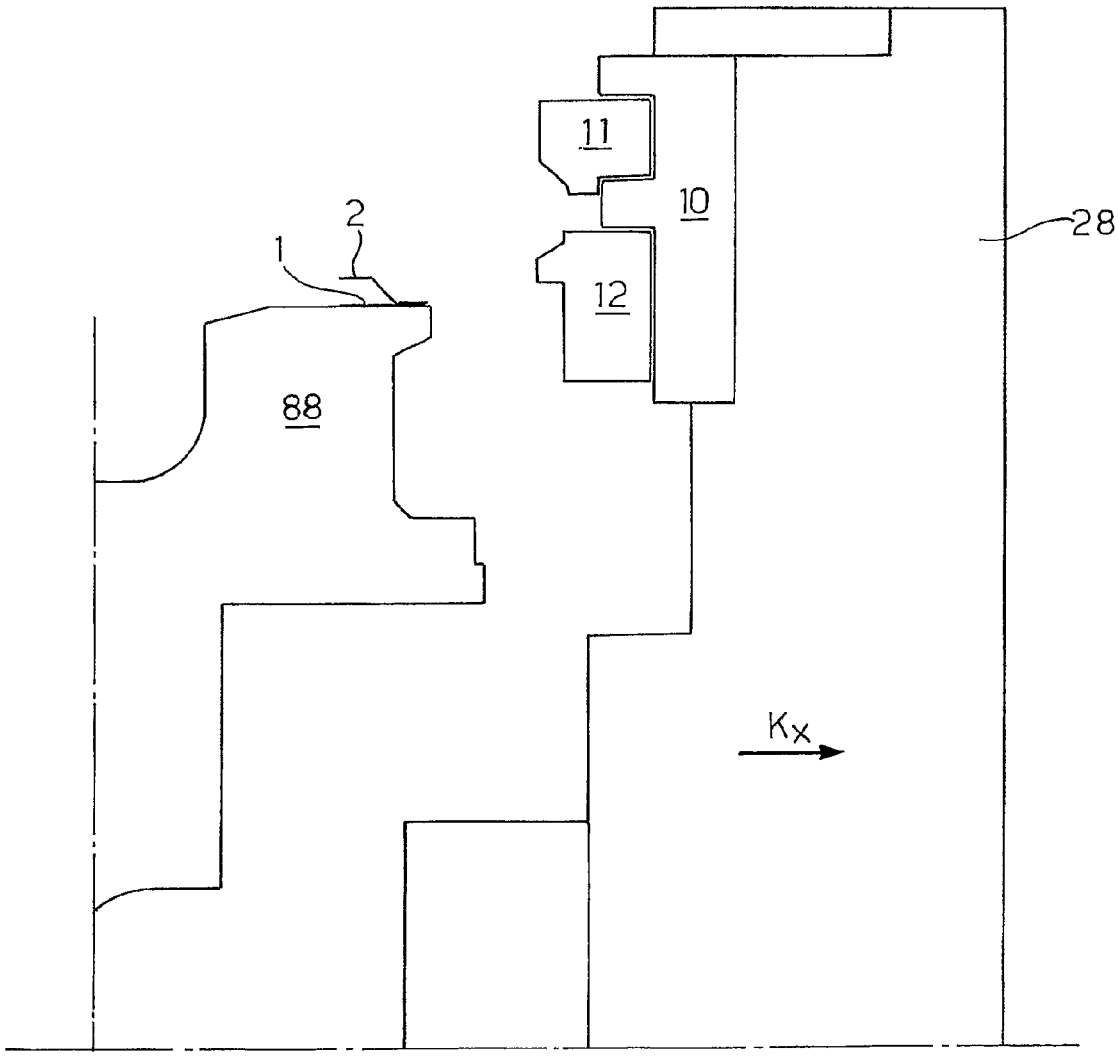
Figure 12J:
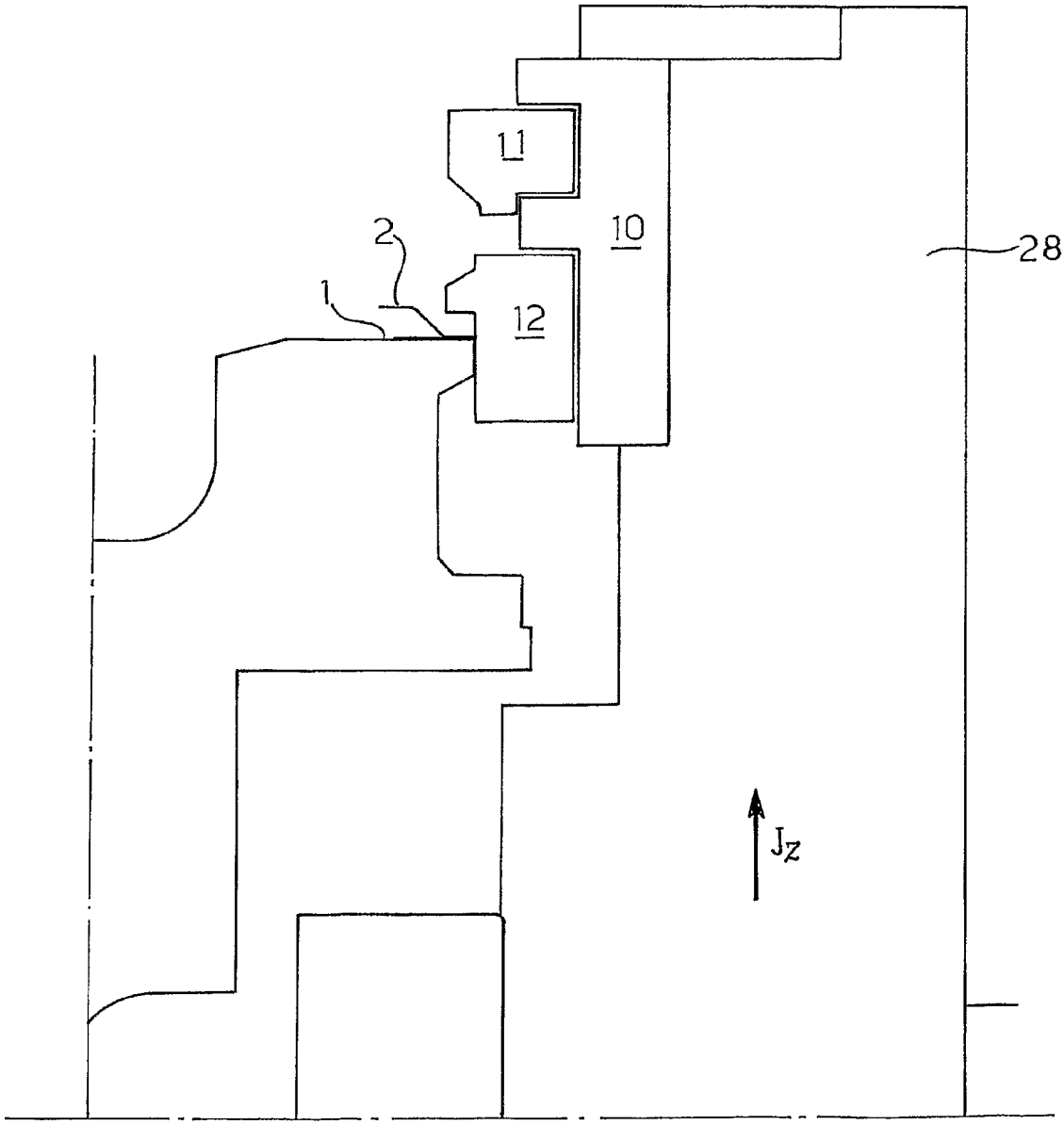

FIG. 12J shows the machine in a "detachment after final flanging" position, achieved by vertically moving the movable unit 28 upwards (arrow $J_Z$), so as to move the final-flanging tool 12 away from edge 3*a*.

Finally (FIG. 12K), the movable unit 28 is again moved away from the workpiece-carrying structure 88 by a longitudinal movement (arrow $K_X$), thereby getting back in the "loading/unloading" position.

This work-cycle is performed by imparting a predetermined sequence of commands to the geared motor units 34 and 60 which control the longitudinal and vertical movements, respectively, of the movable unit 28. The vertical movements of the unit 28 are also determined by the shape of the outline 76*a* of the cam 76.

The shape of the outline 76*a* of the cam 76 according to a preferred embodiment of the invention and the sequence of commands imparted by the geared motor unit 60 to the cam in order to perform the work-cycle described above will be explained now in detail, with reference to FIG. 11 and FIGS. 13 to 17.

Figure 11:
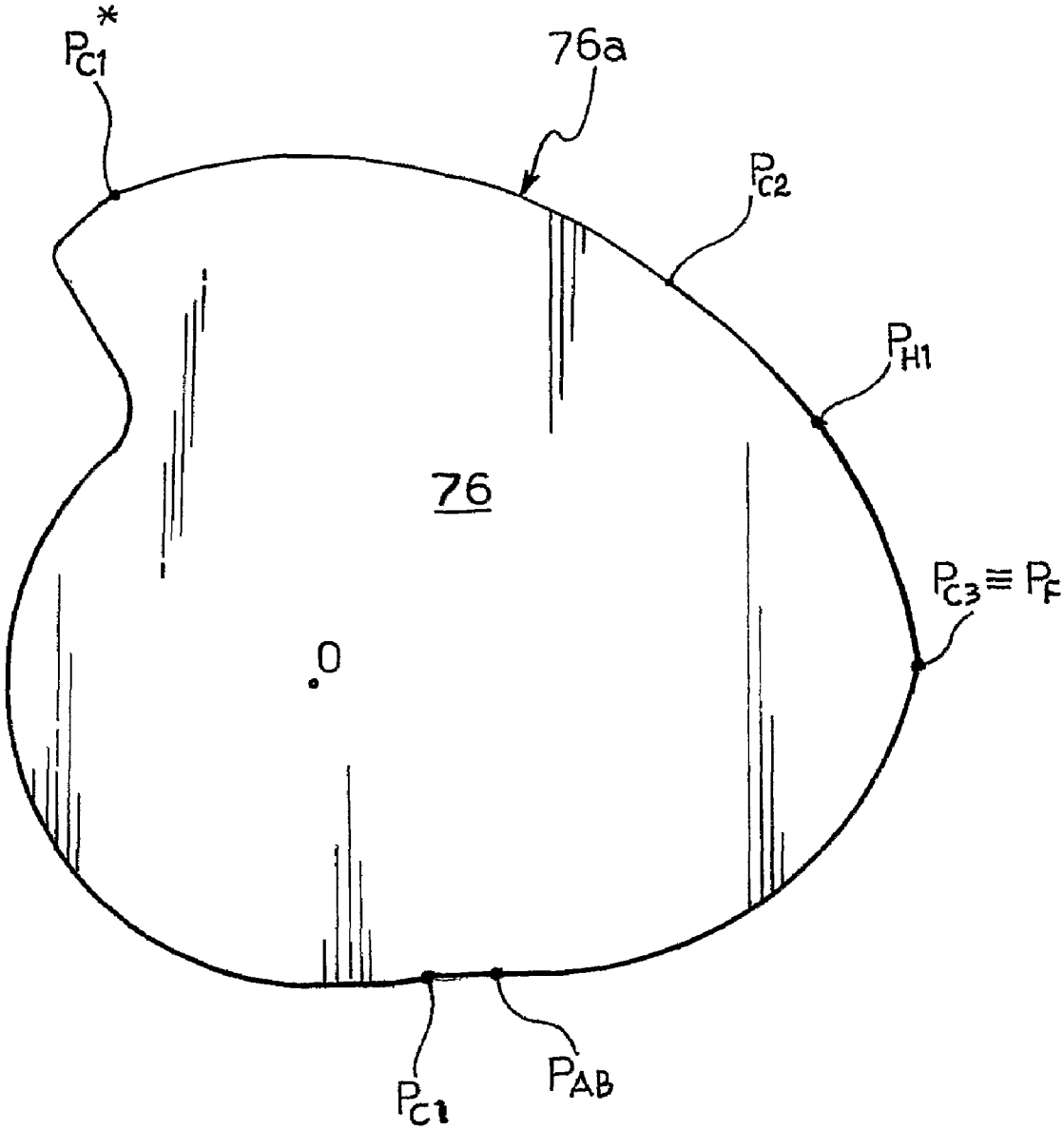
FIG. 11 is a plan view which shows the outline of the cam of the flanging machine of FIG. 3.

The outline 76*a* of the cam 76 is shown in FIG. 11, where the centre of rotation of the cam is indicated O. On the other hand, FIGS. 13 to 17 illustrate the angular positions reached by the cam 76 in the different working positions previously mentioned.

In a first phase, the two panels to be flanged are loaded onto the workpiece-carrying structure 88, while the machine is in the "loading/unloading" position illustrated in FIG. 12A. In a second phase, the movable unit 28 is moved longitudinally to the "pre-flanging start" position illustrated in FIG. 12B. During these first two phases the movable unit 28 is not moved vertically, but the cam 76 is held in the initial position shown in FIG. 13, in which the cam contacts the lower roller 78 in a point $P_{AB}$ of its outline.

In a third phase, the pre-flanging is performed, whereby the movable unit 28 is vertically moved downwards until it reaches the "pre-flanging end" position illustrated in FIG. 12C. This third phase is comprised of the following three steps.

The cam 76, which rests on the lower roller 78 together with the whole movable unit 28 drivingly connected thereto, is first caused to rotate counter-clockwise in such a manner that its point of contact with the roller 78 moves from point $P_{AB}$ specified above to a second point $P_{C1}$. The segment of cam outline 76*a* comprised between points $P_{AB}$ and $P_{C1}$ is shaped in such a manner that it causes the movable unit 28 to move downwards until the working surface 11*a* of the pre-flanging tool 11 is brought into contact with the 90-degree-bent edge 3*a* of the sheet metal outer panel 1.

The outline portion 76*a* of the cam 76 following point $P_{C1}$ would correspond to a further downward movement of the movable unit 28, if this latter continued to rest with the cam 76 on the lower roller 78. As a matter of fact, by causing the cam 76 to rotate counter-clockwise again, the movable unit 28 remains "suspended" on the edge 3*a* of the panel 1 with its tool 11, while the cam 76 disengages from the lower roller 78 and starts to engage with the upper roller 86, drivingly connected to the workpiece-carrying structure 88, starting approximately from a point $P_{C1}$* opposite point $P_{C1}$ or from a following adjacent point. This second step provides for a rotation through nearly 60 degrees, until the cam 76 comes into contact with the upper roller 86 in a point $P_{C2}$. Since the outline segment comprised between points $P_{C1}$* and $P_{C2}$ is an arc of circumference, no vertical movements of the movable unit 28 take place during this second step.

Figure 14:
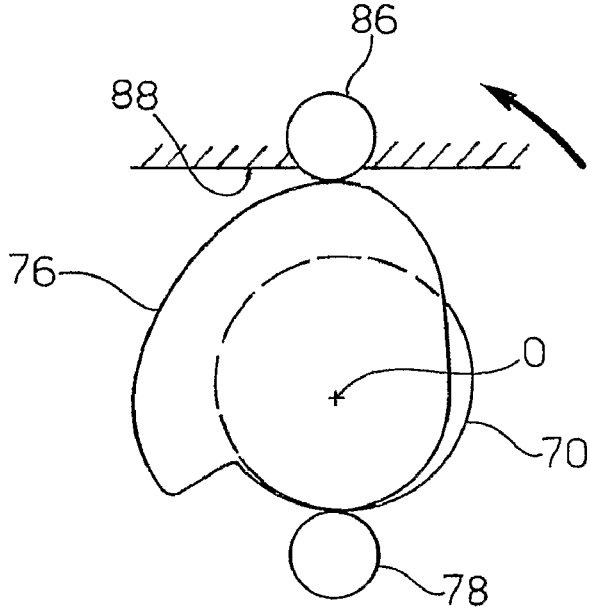

As the cam 76 continues to be rotated, it engages with the upper roller 86 along the outline segment 76*a* comprised between point $P_{C2}$ and a point $P_{C3}$ and finally reaches the position shown in FIG. 14. Since this outline segment provides for an increase in the radial distance from the centre of rotation O, the cam 76 is urged downwards dragging with it the movable unit 28 and the tool-carrying unit 10 mounted thereon. The pre-flanging tool 11 can thus perform the pre-flanging operation, by exerting on the edge 3*a* of the panel 1 a bending force which is the sum of the weight of the movable unit 28 and of the downward load brought about by the interaction of the cam 76 with the upper roller 86.

In a fourth phase, the movable unit 28 is moved vertically upwards until it returns into the "pre-flanging start" position. To this end, the cam 76 is caused to rotate clockwise until it returns into the initial position shown in FIG. 13, in which it contacts the lower roller 78 in point $P_{AB}$.

Figure 13:
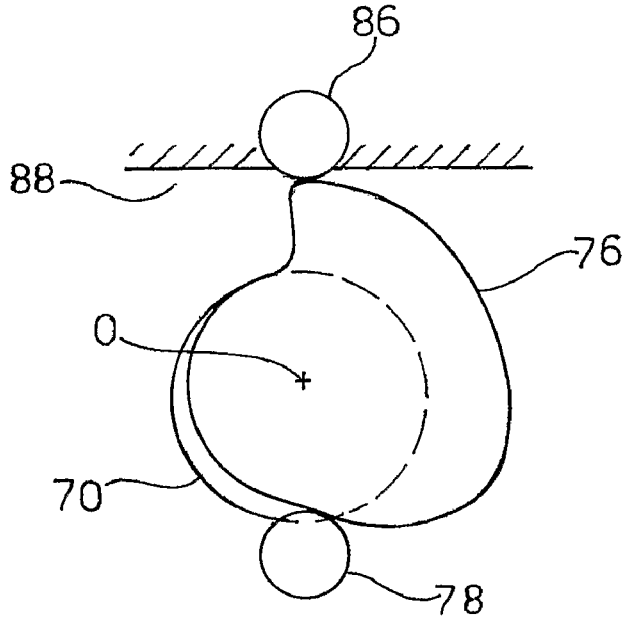
FIGS. 13 to 17 show the angular positions of the cam of a flanging machine according to the invention at respective characteristic points of the work-cycle illustrated in FIGS. 12A to 12K.

In a fifth phase, the movable unit 28 is moved longitudinally until it reaches the "loading/unloading" position illustrated in FIG. 12E, while the 1*a* cam 76 is held stationary in the initial position of FIG. 13.

In a sixth phase, the movable unit 28 is moved vertically upwards until it reaches the "preparation for final flanging" position illustrated in FIG. 12F. To this end, the cam 76 is caused to rotate clockwise whereby the point of contact with the lower roller 78 moves along the outline segment comprised between point $P_{AB}$ and a point $P_F$ (which coincides with point $P_{C3}$ previously identified), as shown in FIG. 15.

Figure 15:
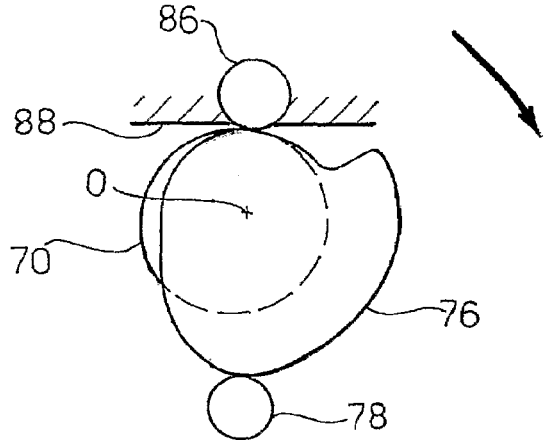

In a seventh phase, the movable unit 28 is moved longitudinally towards the workpiece-carrying structure 88 until it reaches the "final-flanging start" position illustrated in FIG. 12G, while the cam 76 is held stationary in the angular position shown in FIG. 15.

In an eighth phase, the final flanging is performed by moving the movable unit 28 vertically downwards up to the "final-flanging end" position illustrated in FIG. 12H. To this end, the cam 76 is caused to rotate clockwise until it reaches the angular position shown in FIG. 16. As well as for the pre-flanging phase, the final-flanging phase also is comprised of three steps.

First the cam 76 is caused to rotate clockwise in such a manner that its point of contact with the lower roller 78 moves from point $P_F$ specified above to a point $P_{H1}$. The outline segment 76*a* of the cam comprised between points $P_F$ and $P_{H1}$ is shaped in such a manner that it brings about a downward movement of the movable unit 28 until the working surface 12*a* of the final-flanging tool 12 is brought into contact with the 45-degree-bent edge 3*a* of the sheet metal outer panel 1.

As the cam 76 continues to be rotated clockwise, it disengages from the lower roller 78, while the movable unit 28 remains "suspended" on the bent edge 3*a*. At the same time, the eccentric annular member 72, which is fast for rotation with the cam 76, starts to engage with an abutment surface 90 provided by the workpiece-carrying structure 88, namely by the support portion 84 fixed to this structure (which can be seen in the side-sectional view of FIG. 6).

In a similar way to what has been described with reference to the pre-flanging operation, as a result of the interaction between the outline of the eccentric annular member 72 and the abutment surface 90, the movable unit 28 and the tool-carrying unit 10 mounted thereon are urged downwards until they reach the "final-flanging end" position. During this third step, the final-flanging tool 12 exerts on the edge 3*a* of the panel 1 a bending force which is the sum of the weight of the movable unit 28 and the downward load produced by the interaction of the eccentric annular member 72 with the abutment surface 90.

By suitably dimensioning the annular eccentric member 72, the load which is obtained during the final flanging phase is advantageously far higher (for example, nearly four times higher) than that exerted during the pre-flanging phase. Moreover, since the bending force exerted by the tool 12 on the edge 3*a* is substantially aligned with the contact force between the annular eccentric member 72 and the abutment surface 90 (as is visible from the side sectional view of FIG. 6), these forces do not produce a torque which could adversely affect the working precision.

In a nine phase, the movable unit 28 is moved vertically upwards until it gets back in the "final-flanging start" position. To this end, the cam 76 is caused to rotate counter-clockwise until it gets back in the angular position shown in FIG. 16, in which it contacts the lower roller 78 in point $P_F$.

Figure 16:
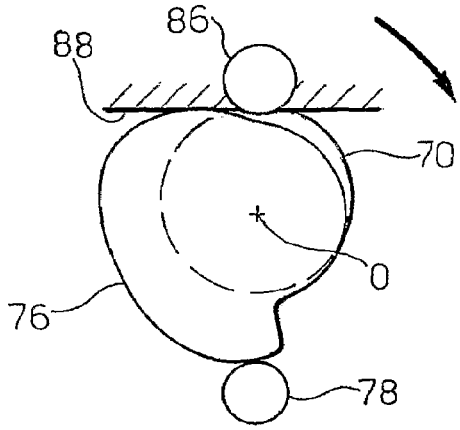
Figure 17:
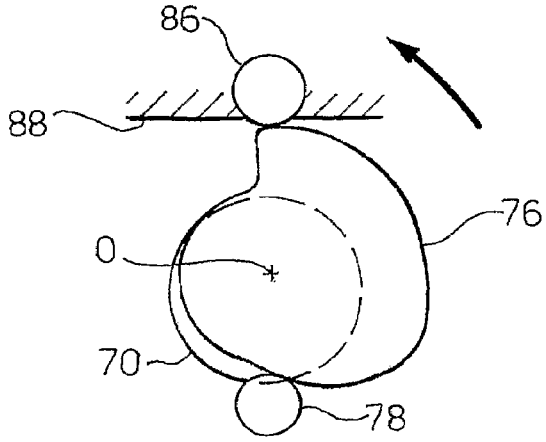

A tenth phase follows, in which the movable unit 28 is moved away longitudinally from the workpiece-carrying structure 88 until it reaches the "loading/unloading" position illustrated in FIG. 12K, while the cam 76 is held stationary in the angular position of FIG. 16.

In a last phase, the movable unit 28 is moved vertically downwards so as to get back in the cycle start position of FIG. 12A. To this end, the cam 76 is caused to rotate counter-clockwise until its point of contact with the lower roller 78 is brought at point $P_{AB}$ of its outline, as shown in FIG. 18. At this time, with the movable unit 28 held in position, the worked piece is unloaded.

Naturally, the principle of the invention remaining unchanged, embodiments and manufacturing details may vary widely from those described and illustrated purely by way of non-limiting example.

In particular, although there is described and illustrated a preferred embodiment of a flanging machine arranged to perform a double-phase flanging operation (45-degree pre-flanging and 90-degree final-flanging), it is clear that the same machine can be easily modified in a suitable manner for performing any other type of flanging operation, for example with a different pre-flanging angle or without the pre-flanging phase, or again with a different final-flanging angle.

Moreover, it is clear that a machine according to the invention can also be used to perform other types of working which provide for the application of a bending force in a given direction. By suitably modifying the outline of the cam, in fact, it is possible to make the tool-carrying unit to move according to a movement law suitable for the particular type of working to be performed.

The invention claimed is:

1. A machine (20) for the working of sheet metal parts (1, 2), comprising a tool-carrying unit (10; 11, 12);

a workpiece-carrying structure (88); a supporting structure (24, 26);

a movable unit (28) which carries the tool-carrying unit (10; 11, 12) and is slidably mounted on the supporting structure (24, 26) along a first direction (Z), or working direction; and a first driving system for controlling the movement of the movable unit (28) in the first direction (Z), the first driving system including a first driving shaft (62), a first. motor unit (60) for controlling the rotation of the first driving shaft (62) and a mechanism for converting the rotational movement of the first driving shaft (62) into the translational movement of the movable unit (28), wherein the said mechanism comprises a first cam member (76) driven by the driving shaft (62) and a first engagement surface (86) arranged to co-operate with an outline (76*a*) of the first cam member (76) to bring about a first working movement of the movable unit (28);

characterized in that the first engagement surface (86) is provided by the workpiece-carrying structure (88).

2. A machine according to claim 1, wherein the first engagement surface (86) is provided on an opposite side of the workpiece-carrying structure (88) to the one on which the metal parts (1, 2) to be worked are arranged.

3. A machine according to claim 1, wherein the first engagement surface is a cylindrical surface provided by a first roller member (86) rotatably mounted on the workpiece-carrying structure (88).

4. A machine according to claim 1, wherein the cam member (76) is carried by the movable unit (28).

5. A machine according to claim 4, wherein the first driving shaft (62) is carried by the movable unit (28) and the cam member (76) is mounted on the first driving shaft (62).

6. A machine according to claim 5, wherein the first motor unit (60) is also carried by the movable unit (28).

7. A machine according to claim 1, wherein the mechanism for converting the rotational movement of the shaft (62) into the translational movement of the movable unit (28) further comprises a second engagement surface (78) arranged to co-operate with the outline (76*a*) of the first cam member (76) to bring about a return movement of the movable unit (28).

8. A machine according to claim 7, wherein the second engagement surface (78) is on an opposite side of the first cam member (76) to the first engagement surface (86).

9. A machine according to claim 7, wherein the second engagement surface is a cylindrical surface provided by a second roller member (78) rotatably mounted on the supporting structure (24, 26).

10. A machine according to claim 9, wherein the axes of rotation of the first cam member (76), of the first roller member (86) and of the second roller member (78) are substantially aligned along the first direction (Z).

11. A machine according to claim 1, wherein the mechanism for converting the rotational movement of the first shaft (62) into the translational movement of the movable unit (28) further comprises a second cam member (72) driven by the first driving shaft (62) and a third engagement surface (90) arranged to co-operate with the second cam member (72) to bring about a second working movement of the movable unit (28).

12. A machine according to claim 11, wherein the direction of the said first working movement of the movable unit (28) is the same as that of the said second working movement.

13. A machine according to claim 12, wherein the tool-carrying unit (10; 11, 12) carries a first pre-flanging tool (11) and a second final-flanging tool (12) in such a manner that the machine is adapted to perform a flanging operation in a first pre-flanging phase and in a second final-flanging phase, and the first driving system is configured in such a manner to drive the said first working movement of the movable unit (28) to perform the pre-flanging phase and the said second working movement of the movable unit (28) to perform the final-flanging phase.

14. A machine according to claim 1, further comprising a stationary base (22), wherein the supporting structure (24, 26) is slidably mounted on the stationary base (22) along a second direction (X), substantially perpendicular to the first direction (Z), in such a manner that the movable unit (28) can be moved towards and away from the workpiece-carrying structure (88).

15. A machine according to claim 14, further comprising a second driving system for controlling the movement of the movable unit (28) along the second direction (X), wherein the said second driving system includes a second motor unit (34) and a crank mechanism (36) for converting the rotational movement outputted by the second motor unit (34) into the translational movement of the movable unit (28) along the second direction (X).

* * * * *